US009279419B2

(12) United States Patent
French

(10) Patent No.: US 9,279,419 B2
(45) Date of Patent: Mar. 8, 2016

(54) SYSTEM AND PROCESS FOR SUPPLYING A CHEMICAL AGENT TO A PROCESS FLUID

(71) Applicant: Prochem ULC, Calgary (CA)

(72) Inventor: Shawn French, Sundre (CA)

(73) Assignee: Prochem ULC, Alberta (CA)

( * ) Notice: Subject to any disclaimer, the term of this patent is extended or adjusted under 35 U.S.C. 154(b) by 79 days.

(21) Appl. No.: 13/743,189

(22) Filed: Jan. 16, 2013

(65) Prior Publication Data

US 2014/0196794 A1 Jul. 17, 2014

(51) Int. Cl.
*F17D 1/17* (2006.01)
*F04B 13/00* (2006.01)

(52) U.S. Cl.
CPC ..... *F04B 13/00* (2013.01); *Y10T 137/0352* (2015.04)

(58) Field of Classification Search
CPC ..... F14B 13/00; F04B 13/00
USPC ..... 137/13, 563, 565.35, 605
See application file for complete search history.

(56) References Cited

U.S. PATENT DOCUMENTS

| | | | | |
|---|---|---|---|---|
| 2,877,929 A | | 3/1959 | Ireland | |
| 3,053,320 A | | 9/1962 | Steincamp | |
| 3,235,348 A | | 2/1966 | Witcher | |
| 3,428,061 A | | 2/1969 | Graham | |
| 4,007,755 A | * | 2/1977 | Lerner et al. | 137/101.21 |
| 4,263,926 A | | 4/1981 | Drake et al. | 137/13 |
| 4,326,585 A | | 4/1982 | McStravick | 166/244.1 |
| 4,375,833 A | | 3/1983 | Meadows | 166/64 |
| 4,399,105 A | | 8/1983 | Tilgner et al. | 422/111 |
| 4,611,294 A | | 9/1986 | Stanfill | 700/68 |
| 4,635,723 A | | 1/1987 | Spivey | 166/310 |
| 4,688,589 A | | 8/1987 | Brainerd et al. | 137/13 |

(Continued)

FOREIGN PATENT DOCUMENTS

| | | |
|---|---|---|
| CN | 102023653 | 4/2011 |
| EP | 1030098 | 8/2000 |

(Continued)

OTHER PUBLICATIONS

Christopher Poe, The In's and Out's of Metering Pumps, Cole-Parmer, Mar. 11, 2012, http://www.coleparmer.ca/TechLibraryArticle/409.

(Continued)

*Primary Examiner* — John Fox
*Assistant Examiner* — Reinaldo Sanchez-Medina
(74) *Attorney, Agent, or Firm* — Clegg, PC; Perry S. Clegg

(57) ABSTRACT

There is provided a process for controllably supplying a chemical agent to a flowing process fluid for effecting generation of treated flowing fluid comprising a chemical agent-derived fluid component material, wherein the chemical agent-derived fluid component material is derived from the chemical agent. The controllably supplying comprises: while discharging a chemical agent from a chemical agent supply system, modulating distribution of the chemical agent that is being discharged, between at least a flowing process fluid and a fluid bypass, with a chemical agent supply modulation system, in accordance with a system operating cycle, wherein the system operating cycle includes a single system supply mode and a single system bypass mode, and wherein the system bypass mode follows the system supply mode.

43 Claims, 6 Drawing Sheets

(56) References Cited

U.S. PATENT DOCUMENTS

| | | | | |
|---|---|---|---|---|
| 4,736,769 | A | 4/1988 | Belanger | 137/564.5 |
| 4,748,011 | A | 5/1988 | Baize | 423/228 |
| 4,887,640 | A | 12/1989 | Down | 137/564.5 |
| 5,020,561 | A | 6/1991 | Li | 137/13 |
| 5,490,766 | A | 2/1996 | Zeck | 417/63 |
| 5,609,178 | A | 3/1997 | Hennig et al. | 137/10 |
| 6,019,250 | A | 2/2000 | Pozniak et al. | 222/1 |
| 6,073,653 | A | 6/2000 | Nishio et al. | 137/599.13 |
| 6,142,162 | A | 11/2000 | Arnold | 137/3 |
| 6,776,188 | B1 | 8/2004 | Rajewski | 137/624.13 |
| 6,779,539 | B1 | 8/2004 | Schwamberger et al. | 137/1 |
| 6,851,444 | B1 | 2/2005 | Kohl et al. | 137/13 |
| 6,899,282 | B1 | 5/2005 | Hill | 239/61 |
| 6,981,848 | B1 * | 1/2006 | Cessac | 417/14 |
| 7,072,742 | B1 | 7/2006 | Bellafiore et al. | 700/265 |
| 7,395,864 | B2 | 7/2008 | Ramachandran et al. | 166/310 |
| 7,661,871 | B2 | 2/2010 | Hyatt et al. | 366/136 |
| 7,930,877 | B2 | 4/2011 | Nardi et al. | 60/278 |
| 8,091,575 | B2 * | 1/2012 | Gammon | 137/88 |
| 8,268,167 | B2 | 9/2012 | Dawes et al. | 210/121 |
| 8,475,550 | B2 * | 7/2013 | Zeck | 48/195 |
| 2005/0155644 | A1 | 7/2005 | Woollums | 137/3 |
| 2007/0109912 | A1 | 5/2007 | Urquhart et al. | 366/136 |
| 2009/0000664 | A1 | 1/2009 | Perry et al. | 137/2 |
| 2009/0095351 | A1 | 4/2009 | Greening et al. | 137/3 |
| 2009/0242035 | A1 | 10/2009 | Zeck | 137/3 |
| 2010/0011875 | A1 | 1/2010 | Vyas et al. | 73/861.04 |
| 2010/0263736 | A1 | 10/2010 | Issartel | 137/101.19 |
| 2011/0308625 | A1 | 12/2011 | Stoisits | 137/1 |
| 2012/0167465 | A1 | 7/2012 | Zeck | 48/127.3 |

FOREIGN PATENT DOCUMENTS

| | | |
|---|---|---|
| EP | 1516958 | 3/2005 |
| JP | 1185492 | 7/1989 |
| JP | 9310804 | 12/1997 |
| WO | WO/02/069066 | 9/2002 |
| WO | WO/2012/114259 | 8/2012 |

OTHER PUBLICATIONS

Free Online Encyclopedia, definition of single stage pump, Apr. 11, 2012, http://encyclopedia2.thefreedictionary.com/single-stage+pump.

The Engineering ToolBox, Positive Displacement Pumps, Mar. 11, 2012, http://www.engineeringtoolbox.com/positive-displacement-pumps-d_414.html.

Wikipedia, Metering Pump, Mar. 11, 2012, http://en.wikipedia.org/wiki/Metering_pump.

wiseGEEK, What is a Metering Pump?, Apr. 11, 2012, http://www.wisegeek.com/what-is-a-metering-pump.htm.

* cited by examiner

Injection test results, 1 minute cycle period, 24 hour tests.

| Pressure | B.T. | Rate | Target | Actual | plus/minus |
|---|---|---|---|---|---|
| 90 | 4 | 4 | 2 | 1.6 | 0.4 |
| | 4 | 5 | 2 | 1.5 | 0.5 |
| | 6 | 4 | 1 | 0.8 | 0.2 |
| | 4 | 4 | 2 | 1.6 | 0.4 |
| | 6 | 4 | 2 | 1.3 | 0.7 |
| | 8 | 4 | 2 | 1.6 | 0.4 |
| | 8 | 4 | 2 | 1.5 | 0.5 |
| | 10 | 4 | 2 | 1.6 | 0.4 |

observation during a 1 hour period!

pump rate: 5.5 l/d
target rate: 1.0 l/d
build time of 8 seconds, one minute cycle period. ( B.T. = build time)
During the 1 hour test it was observed that the pump was on its suction stroke for 8 cycles so those 8 cycles never delivered any treatment chemical to the intended injection point.

FIGURE 4

Injection test results, 2 minute cycle period, 24 hour tests.

| Pressure | Build time | Rate | Target | Actual | plus/minus |
|---|---|---|---|---|---|
| 90 | 2 | 7 | 3 | 2.4 | -0.6 |
| | 3 | 7 | 3 | 2.7 | -0.3 |
| | 4 | 7 | 3 | 2.9 | -0.1 |
| | 5 | 7 | 3 | 3.2 | 0.2 |
| | | | | | |
| | 4 | 4 | 2 | 2 | 0 |
| | 4 | 4 | 2 | 2.1 | 0.1 |
| | 6 | 5.5 | 1 | 1.1 | 0.2 |
| | 4 | 5.5 | 1 | 1.1 | 0.1 |
| | 6 | 4 | 1.5 | 1.5 | 0 |
| | | | | | |
| 200 | 8 | 7.5 | 2 | 2.4 | 0.4 |
| | | | | | |
| 300 | 8 | 6 | 2 | 2.35 | 0.35 |
| | 6 | 4 | 2 | 2 | 0 |
| | | | | | |
| 500 | 8 | 6 | 2 | 2.2 | 0.2 |
| | 8 | 4 | 1 | 1.15 | 0.15 |
| | 5 | 2.3 | 1 | 1 | 0 |
| | | | | | |
| 600 | 8 | 4 | 1 | 1.2 | 0.2 |
| | | | | | |
| 1000 | 10 | 4 | 1 | 1.15 | 0.15 |
| | 10 | 4 | 1 | 1.1 | 0.1 |
| | 6 | 3.3 | 1 | 1 | 0 |
| | 5 | 3 | 1 | 1 | 0 |
| | | | | | |
| 1400 | 10 | 4 | 1 | 1.1 | 0.1 |
| | 7 | 3 | 1 | 0.93 | -0.07 |
| | 10 | 5 | 2 | 2.15 | 0.15 |
| | 10 | 4 | 2 | 2.15 | 0.15 |
| | 10 | 3 | 1 | 1.1 | 1.1 |

FIGURE 5

SYSTEM AND PROCESS FOR SUPPLYING A CHEMICAL AGENT TO A PROCESS FLUID

CROSS-REFERENCE TO RELATED APPLICATIONS

The application claims priority to Canadian Patent Application No. (not yet assigned) filed Jan. 15, 2013, Titled "SYSTEM AND PROCESS FOR SUPPLYING A CHEMICAL AGENT TO A PROCESS FLUID." The contents of the referenced application are incorporated into the present application by reference.

FIELD

The present disclosure relates to chemical addition systems for hydrocarbon-comprising process fluids.

BACKGROUND

Oil and gas, being distributed through pipelines, typically require chemical addition to mitigate against various undesirable phenomena, such as corrosion, scaling, and solids deposition.

The required concentrations of these chemical agents is relatively low. Unfortunately, existing metering pumps, for delivering these chemical agents, are unable to reliably supply these chemical agents at the low rates required to achieve these relatively low concentrations. As a result, these chemical agents tend to be over-injected, resulting in waste and unnecessary costs. Even if it is attempted to inject chemical agents with existing pumps at relatively low rates, by having the pump stroke over extended periods, the result is more of a pulsed injection, and a relatively significant departure from continuous injection, thereby resulting in non-uniform protection of the process fluid being injected with the chemical agent. Other inherent problems with low pumping rate include the increased risk of vapour lock, or loss of prime, in the pump head.

SUMMARY

In one aspect, there is provided a process for controllably supplying a chemical agent to a flowing process fluid for effecting generation of treated flowing fluid comprising a chemical agent-derived fluid component material, wherein the chemical agent-derived fluid component material is derived from the chemical agent. The controllably supplying comprises: while discharging a chemical agent from a chemical agent supply system, modulating distribution of the chemical agent that is being discharged, between at least a flowing process fluid and a fluid bypass, with a chemical agent supply modulation system, in accordance with a system operating cycle, wherein the system operating cycle includes a single system supply mode and a single system bypass mode, and wherein the system bypass mode follows the system supply mode, and wherein the system operating cycle is repeated at least once such that alternating is effected as between the system supply mode and the system bypass mode, and such that a corresponding plurality of occurrences of the system supply mode and a corresponding plurality of occurrences of the system bypass mode are provided; wherein, over the entire duration of the system supply mode, fluid communication between the chemical agent supply system and the flowing process fluid is being effected; and wherein, over the entire duration of the system bypass mode, fluid communication between the chemical agent supply system and the fluid bypass is being effected; and wherein the chemical agent supply modulation system includes a bypass fluid flow interference device and a fluid pressure-responsive sealing device; and wherein, over the entire duration of the system supply mode, the bypass fluid flow interference device is disposed in a supply mode condition, and over the entire duration of the system bypass mode, the bypass fluid flow interference device is disposed in a bypass mode condition; and wherein the bypass fluid flow interference device is disposed between the chemical agent supply system and the fluid bypass, and is configured for selectively interfering with fluid communication between the chemical agent supply system and a fluid bypass, and when disposed in the supply mode condition, the bypass fluid flow interference device is disposed so as to effect relatively more interference with fluid communication between the chemical agent supply system and the fluid bypass, than when disposed in the bypass mode condition; and wherein the fluid pressure-responsive sealing device is disposed between the chemical agent supply system and the flowing process fluid, and is urged by downstream fluid pressure, for effecting sealing, or substantial sealing, of the fluid communication between the chemical agent supply system and the flowing process fluid, and the fluid pressure-responsive sealing device is configured to effect the sealing, or substantial sealing, while fluid pressure upstream of the fluid pressure-responsive sealing device is failing to sufficiently exceed the downstream fluid pressure, wherein the downstream fluid pressure is being communicated by the flowing process fluid; and wherein the bypass fluid flow interference device and the fluid pressure-responsive sealing device are co-operatively configured such that, while the chemical agent supply system is pressurizing the chemical agent upstream of both of the bypass fluid flow interference device and the fluid pressure-responsive sealing device, the fluid pressure upstream of the fluid pressure-responsive sealing device, which opposes the downstream fluid pressure that is urging the fluid pressure-responsive sealing device to effect sealing, or substantial sealing, of the fluid communication between the chemical agent supply system and the flowing process fluid, is responsive to the degree of interference being effected, to the fluid communication between the chemical agent supply system and the fluid bypass, by the bypass fluid flow interference device.

In another aspect, there is provided a process for controllably supplying a chemical agent to a flowing process fluid for effecting generation of treated flowing fluid comprising a chemical agent-derived fluid component material, wherein the chemical agent-derived fluid component material is derived from the chemical agent. The controllably supplying comprises: while discharging a chemical agent from a chemical agent supply system, modulating distribution of the chemical agent that is being discharged, between at least a flowing process fluid and a fluid bypass, with a chemical agent supply modulation system, wherein the distribution affecting condition of the chemical agent supply modulation system alternates between a system supply mode and a system bypass mode such that a plurality of occurrences of the system supply mode and a corresponding plurality of occurrences of the system bypass mode are provided; wherein, over the entire duration of the system supply mode, fluid communication between the chemical agent supply system and the flowing process fluid is being effected; and wherein, over the entire duration of the system bypass mode, fluid communication between the chemical agent supply system and the fluid bypass is being effected; and wherein the chemical agent supply modulation system includes a bypass fluid flow interference device and a fluid pressure-responsive sealing device;

and wherein, over the entire duration of the system supply mode, the bypass fluid flow interference device is disposed in a supply mode condition, and over the entire duration of the system bypass mode, the bypass fluid flow interference device is disposed in a bypass mode condition; and wherein the bypass fluid flow interference device is disposed between the chemical agent supply system and the fluid bypass, and is configured for selectively interfering with fluid communication between the chemical agent supply system and a fluid bypass, and when disposed in the supply mode condition, the bypass fluid flow interference device is disposed so as to effect relatively more interference with fluid communication between the chemical agent supply system and the fluid bypass, than when disposed in the bypass mode condition; and wherein the fluid pressure-responsive sealing device is disposed between the chemical agent supply system and the flowing process fluid, and is urged by downstream fluid pressure, for effecting sealing, or substantial sealing, of the fluid communication between the chemical agent supply system and the flowing process fluid, and the fluid pressure-responsive sealing device is configured to effect the sealing, or substantial sealing, while fluid pressure upstream of the fluid pressure-responsive sealing device is failing to sufficiently exceed the downstream fluid pressure, wherein the downstream fluid pressure is being communicated by the flowing process fluid; and wherein the bypass fluid flow interference device and the fluid pressure-responsive sealing device are co-operatively configured such that, while the chemical agent supply system is pressurizing the chemical agent upstream of both of the bypass fluid flow interference device and the fluid pressure-responsive sealing device, the fluid pressure upstream of the fluid pressure-responsive sealing device, which opposes the downstream fluid pressure that is urging the fluid pressure-responsive sealing device to effect sealing, or substantial sealing, of the fluid communication between the chemical agent supply system and the flowing process fluid, is responsive to the degree of interference being effected, to the fluid communication between the chemical agent supply system and the fluid bypass, by the bypass fluid flow interference device.

A process for controllably supplying a chemical agent to a flowing process fluid for effecting generation of treated flowing fluid comprising a chemical agent-derived fluid component material, wherein the chemical agent-derived fluid component material is derived from the chemical agent. The controllably supplying comprises: while discharging a chemical agent from a chemical agent supply system, modulating distribution of the chemical agent that is being discharged, between at least a flowing process fluid and a fluid bypass, with a chemical agent supply modulation system, in accordance with an system operating cycle, wherein the system operating cycle includes a single system supply mode and a single system bypass mode, and wherein the system bypass mode follows the system supply mode, and wherein the system operating cycle is repeated at least once such that alternating is effected as between the system supply mode and the system bypass mode, and such that a corresponding plurality of occurrences of the system supply mode and a corresponding plurality of occurrences of the system bypass mode are provided; wherein, over the entire duration of the system supply mode, fluid communication between the chemical agent supply system and the flowing process fluid is being effected; and wherein, over the entire duration of the system bypass mode, fluid communication between the chemical agent supply system and the fluid bypass is being effected; and wherein the system supply mode is characterized by a predetermined total time duration; and wherein the system bypass mode is characterized by a predetermined total time duration.

In another aspect, there is provided a process for controllably supplying a chemical agent to a flowing process fluid for effecting generation of treated flowing fluid comprising a chemical agent-derived fluid component material, wherein the chemical agent-derived fluid component material is derived from the chemical agent. The controllably supplying comprises: while discharging a chemical agent from a chemical agent supply system, modulating distribution of the chemical agent that is being discharged, between at least a flowing process fluid and a fluid bypass, with a chemical agent supply modulation system, wherein the distribution affecting condition of the chemical agent supply modulation system alternates between a system supply mode and a system bypass mode such that a plurality of occurrences of the system supply mode and a corresponding plurality of occurrences of the system bypass mode are provided; wherein, over the entire duration of the system supply mode, fluid communication between the chemical agent supply system and the flowing process fluid is being effected; and wherein, over the entire duration of the system bypass mode, fluid communication between the chemical agent supply system and the fluid bypass is being effected; and wherein the system supply mode is characterized by a predetermined total time duration; and wherein the system bypass mode is characterized by a predetermined total time duration.

In another aspect, there is provided a process for controllably supplying a chemical agent to a flowing process fluid for effecting generation of treated flowing fluid comprising a chemical agent-derived fluid component material, wherein the chemical agent-derived fluid component material is derived from the chemical agent. The controllably supplying comprises: while discharging a chemical agent from a chemical agent supply system, modulating distribution of the chemical agent that is being discharged, between at least a flowing process fluid and a fluid bypass, with a chemical agent supply modulation system, in accordance with an system operating cycle, wherein the system operating cycle includes a single system supply mode and a single system bypass mode, and wherein the system bypass mode follows the system supply mode, and wherein the system operating cycle is repeated at least once such that alternating is effected as between the system supply mode and the system bypass mode, and such that a corresponding plurality of occurrences of the system supply mode and a corresponding plurality of occurrences of the system bypass mode are provided; wherein, over the entire duration of the system supply mode, fluid communication between the chemical agent supply system and the flowing process fluid is being effected; and wherein, over the entire duration of the system bypass mode, fluid communication between the chemical agent supply system and the fluid bypass is being effected; and wherein the system operating cycle is characterized by a total time duration that is greater than 60 seconds.

In another aspect, there is provided a process for supplying a chemical agent to a flowing process fluid with a chemical agent supply system, wherein the supplying effects generation of treated flowing fluid comprising a chemical agent-derived fluid component material, wherein the chemical agent-derived fluid component material is derived from the chemical agent. The supplying comprises: pressurizing, with a chemical agent supply system, chemical agent which is disposed within a chemical agent supply fluid passage, wherein a fluid pressure-responsive sealing device is disposed within the chemical agent supply fluid passage, between the chemical agent supply system and the flowing process fluid, the fluid pressure-responsive sealing device being urged by downstream fluid pressure, communicated by the flowing process fluid, for effecting sealing, or substantial sealing, of the fluid communication between the chemical agent supply system and the flowing process fluid, and wherein the fluid pressure-responsive sealing device is configured for effecting the sealing, or substantial sealing, while fluid pressure upstream of the fluid pressure-responsive sealing device is failing to sufficiently exceed the downstream fluid pressure, and wherein the chemical agent being pressurized is disposed upstream of the fluid pressure-responsive sealing device; wherein the pressurizing is effected when the fluid pressure-responsive sealing device is disposed such that sealing, or substantial sealing, of fluid communication between the chemical agent supply system and the flowing process fluid is being effected, and the pressurizing is such that the pressure of the chemical agent supply fluid passage-disposed chemical agent, upstream of the fluid pressure-responsive sealing device, sufficiently exceeds the downstream fluid pressure so as to effect a change in disposition of the fluid pressure-responsive sealing device such that fluid communication between the chemical agent supply system and the flowing process fluid is effected, and supplying of the flowing process fluid, with at least a fraction of the chemical agent being discharged by the chemical agent supply system, is effected; wherein the portion of the chemical agent supply fluid passage, within which is disposed the chemical agent that becomes pressurized by the chemical agent supply system such that the chemical agent supply fluid passage-disposed chemical agent becomes disposed at the sufficiently exceeding pressure for effecting disposition of the fluid pressure-responsive interference device such that fluid communication between the chemical agent supply system and the flowing process fluid is effected, has a total volume that is less than 100 milliliters.

In another aspect, there is provided a system for controllably supplying a chemical agent to a flowing process fluid for effecting generation of treated flowing fluid including a chemical agent-derived fluid component material, wherein the chemical agent-derived fluid component material is derived from the chemical agent. The system comprises: a chemical agent supply system, configured for discharging a chemical agent, and disposed for fluid communication with each one of, independently, a process fluid conduit and a fluid bypass conduit; a bypass fluid flow interference device disposed between the chemical agent supply system and the fluid bypass conduit, and configured for selectively interfering with fluid communication between the chemical agent supply system and the fluid bypass conduit, wherein the bypass fluid flow interference device is disposable to a supply mode condition, wherein fluid communication between the chemical agent supply system and the process fluid conduit is being effected, and is also disposable to a bypass mode condition, wherein fluid communication between the chemical agent supply system and the fluid bypass conduit is being effected, wherein, when the bypass fluid flow interference device is disposed in the supply mode condition, the bypass fluid flow interference device is disposed so as to effect relatively more interference to fluid communication between the chemical agent supply system and the fluid bypass conduit, than when disposed in the bypass mode condition; and a fluid pressure-responsive sealing device, disposed between the chemical agent supply system and the process fluid conduit, and configured for being urged by downstream fluid pressure being communicated from the process fluid conduit, for effecting sealing, or substantial sealing, of the fluid communication between the chemical agent supply system and the process fluid conduit, such that the sealing, or substantial sealing, is effected while fluid pressure upstream of the fluid pressure-responsive sealing device is failing to sufficiently exceed the downstream fluid pressure; wherein the bypass fluid flow interference device and the fluid pressure-responsive sealing device are co-operatively configured such that, while the chemical agent supply system is pressurizing the chemical agent upstream of both of the bypass fluid flow interference device and the fluid pressure-responsive sealing device, fluid pressure upstream of the fluid pressure-responsive sealing device, which opposes the downstream fluid pressure that is urging the fluid pressure-responsive sealing device to effect the sealing, or substantial sealing, of the fluid communication between the chemical agent supply system and the process fluid conduit, is responsive to the degree of interference being effected, to the fluid communication between the chemical agent supply system and the fluid bypass conduit, by the bypass fluid flow interference device; such that, when the bypass fluid flow interference device is disposed in the supply mode condition, and while the chemical agent supply system is pressurizing the chemical agent upstream of both of the bypass fluid flow interference device and the fluid pressure-responsive sealing device, the bypass fluid flow interference device is disposed so as to effect a fluid pressure upstream of the fluid pressure-responsive sealing device that sufficiently exceeds the downstream fluid pressure such that fluid communication between the chemical agent supply system and the process fluid conduit is being effected.

In another aspect, there is provided a system for supplying a chemical agent to a flowing process fluid with a chemical agent supply system, wherein the supplying effects generation of treated flowing fluid comprising a chemical agent-derived fluid component material, wherein the chemical agent-derived fluid component material is derived from the chemical agent. The system comprises a chemical agent supply system, configured for discharging a chemical agent, and disposed for fluid communication with each one of, independently, a process fluid conduit and a fluid bypass conduit; a chemical agent supply fluid passage; and a fluid pressure-responsive sealing device, disposed within the chemical agent supply fluid passage, between the chemical agent supply system and the process fluid conduit, and configured for being urged by downstream fluid pressure being communicated from the process fluid conduit, for effecting sealing, or substantial sealing, of the fluid communication between the chemical agent supply system and the process fluid conduit, such that the sealing, or substantial sealing, is effected while fluid pressure upstream of the fluid pressure-responsive sealing device is failing to sufficiently exceed the downstream fluid pressure; wherein, while chemical agent, disposed within the chemical agent supply fluid passage, upstream of the fluid pressure-responsive sealing device, is pressurized by the chemical agent supply system, wherein the pressurizing is effected when the fluid pressure-responsive sealing device is disposed such that sealing, or substantial sealing, of fluid communication between the chemical agent supply system and the process fluid conduit is being effected, such that the pressure of the chemical agent supply fluid passage-disposed chemical agent, upstream of the fluid pressure-responsive sealing device, sufficiently exceeds the downstream fluid pressure, and effects a change in disposition of the fluid pressure-responsive sealing device such that fluid communication between the chemical agent supply system and the process fluid conduit is effected, the portion of the chemical agent supply fluid passage, within which is disposed the chemical agent that becomes pressurized by the chemical agent supply system such that the chemical agent supply fluid passage-disposed chemical agent becomes disposed at the sufficiently exceeding pressure for effecting disposition of the fluid pressure-responsive interference device such that fluid communication between the chemical agent supply system and the process fluid conduit is effected, has a total volume that is less than 100 milliliters.

BRIEF DESCRIPTION OF DRAWINGS

The preferred embodiments will now be described with the following accompanying drawings:

FIG. 4 illustrates injection test results for a system operating cycle having a one-minute cycle duration, using the experimental set-up illustrated in FIG. 3;

FIG. 5 illustrates injection test results for a system operating cycle having a two-minute cycle duration, using the experimental set-up illustrated in FIG. 3.

DETAILED DESCRIPTION

Figure 1:
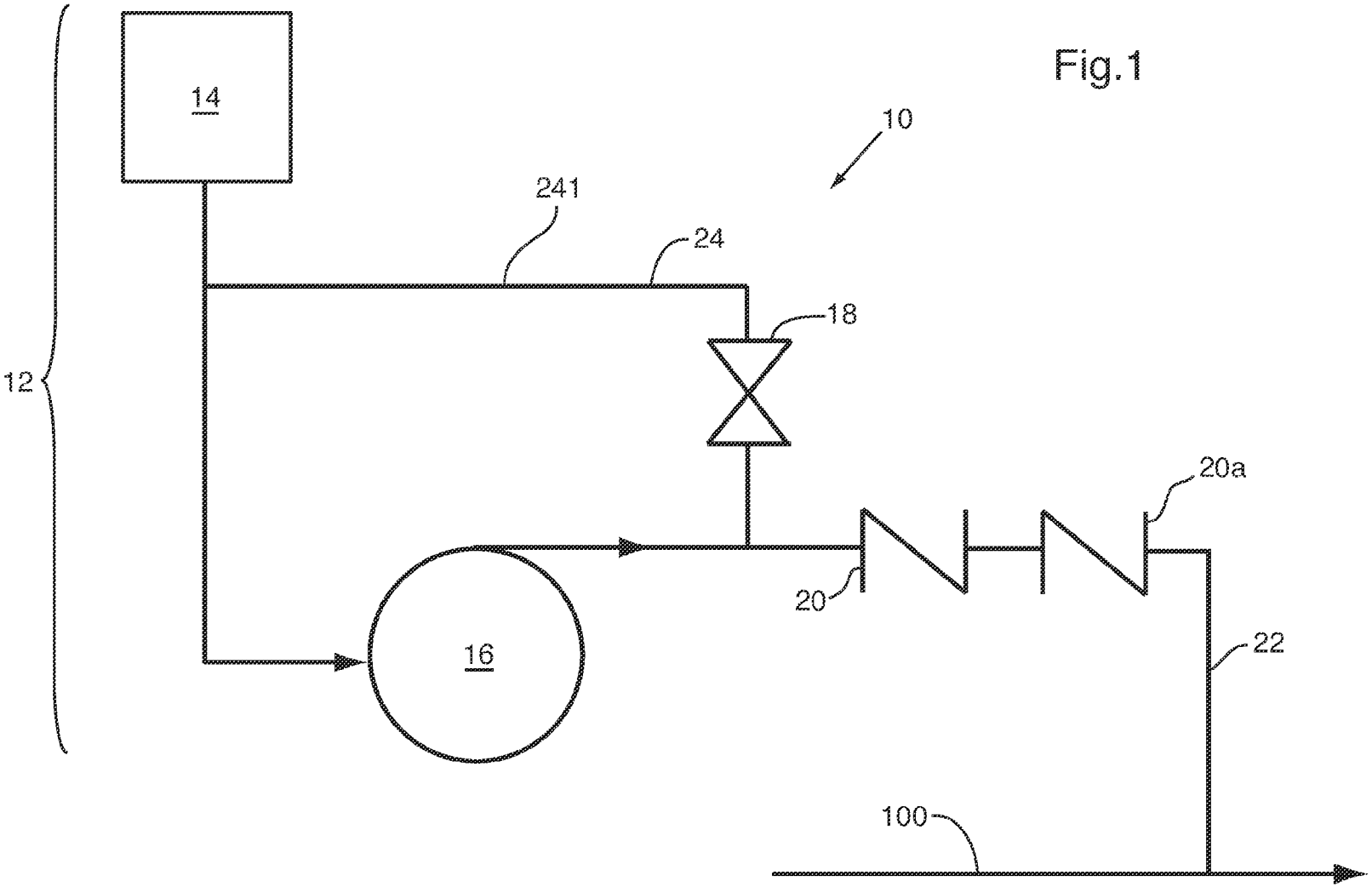
FIG. 1 is a process flow diagram of an embodiment of the present disclosure.

There is provided a system 10 and process for controllably supplying a chemical agent to a flowing fluid for effecting generation of chemical agent-contacted flowing fluid comprising a chemical agent-derived fluid component material. The chemical agent-derived fluid component material is derived from the chemical agent. In some embodiments, dissolution of the chemical agent within the flowing fluid is effected when contacting between the chemical agent and the flowing fluid is effected, such that the chemical agent-derived fluid component material is the solvated form of the chemical agent. In some embodiments, for example, a reactive process is effected when contacting between the chemical agent and the flowing fluid is effected, such that the chemical agent-derived fluid component material is a reaction product generated from the contacting.

In some embodiments, for example, the chemical agent is a material that is configured for contacting with a process fluid for mitigating deterioration of fluid flow components through which the chemical agent-contacted process fluid, or derivatives thereof, is flowed. In some embodiments, for example, the chemical agent is a material that is configured for contacting with a process fluid for facilitating transport of the chemical agent-contacted process fluid, or derivatives thereof. In some embodiments, for example, the chemical agent is a material that is configured for contacting with a process fluid for facilitating the desired effect of unit operations that are applied to the chemical agent-contacted process fluid, or derivative thereof.

In some embodiments, for example, the chemical agent includes a corrosion inhibitor (such as Nalco EC1010™, Champion CORTRON RN 365™, or Baker CGW366™), a scale inhibitor (such as Champion CAPREON 75™), a $H_2S$ scavenger (such as Weatherford SULFACLEAR 8211™ or ProChem PRO-53™), a wax solvent (such as ProChem PRO-302™), a dispersant (such as Weatherford PD-816™ or ProChem PRO-900™), such as an asphaltene dispersant, or an emulsion breaker (such as Baker TRETOLITE DMO 8733 U™), and any combination thereof.

The flowing fluid is a hydrocarbon-comprising fluid, and can be a liquid or a gas, or a mixture of a liquid and a gas. In some embodiments, for example, the flowing fluid is crude oil. Amongst other things, crude oil includes water, and the presence of water contributes corrosive properties, thereby requiring the addition of corrosion inhibitors. In some embodiments, for example, the flowing fluid is natural gas, such as sour natural gas which, amongst other things, is relatively corrosive and requires treatment with a corrosion inhibitor. In some embodiments, for example, the natural gas is in the form of liquefied natural gas.

In some embodiments, for example, the flowing fluid is flowing through a pipeline, such as an outdoor pipeline.

In some embodiments, for example, the pressure of the flowing process fluid is at least 5 psig. In some embodiments, for example, the pressure of the flowing process fluid is at least 1000 psig. In some embodiments, for example, the pressure of the flowing process fluid is at least 2000 psig. In some embodiments, for example, the pressure of the flowing process fluid is at least 5000 psig.

The system includes a chemical agent supply system 12. The chemical agent is discharged to the flowing fluid by the chemical agent supply system. In some embodiments, for example, the chemical agent supply system includes a tank 14, containing an inventory of the chemical agent, and a prime mover 16.

The prime mover 16 is configured for effecting transport and discharge of the chemical agent from the chemical agent supply system. In some embodiments, for example, the prime mover 16 is a pump. In some embodiments, for example, the pump is a metering pump. In some embodiments, for example, the pump is a single stage reciprocating pump, such as a single stage piston pump. In some embodiments, for example, a multi-stage pump is also suitable.

In some embodiments, for example, the pump 16 is an existing pump, integrated within an existing chemical addition system, and fluidly coupled to a flowing process fluid, and configured for supplying a chemical agent to the flowing process fluid. Such existing pump may be retrofitted for use in the system 100 and process of the present disclosure. Examples of suitable pumps include Texsteam 5100™, manufactured by Texsteam Inc., CVS-51™, manufactured by CVS Controls Ltd., and Morgan 55DS™, manufactured by Morgan Products, Inc.

In some embodiments, for example, the flowing process fluid is flowed through a process fluid passage of a process fluid conduit. The supplying of the chemical agent by the chemical agent supply system to the flowing process fluid, that is being flowed through the process fluid passage, is effected through at least one port of the process fluid conduit.

1. Alternating as Between a System Supply Mode and a System Bypass Mode

There is provided a process for controllably supplying a chemical agent to a flowing process fluid for effecting generation of treated flowing fluid comprising a chemical agent-derived fluid component material. The chemical agent-derived fluid component material is derived from the chemical agent.

In one aspect, the controllably supplying includes modulating distribution of the chemical agent, between at least a flowing process fluid and a fluid bypass 24, as it is being discharged by the chemical agent supply system 12, wherein the modulation is effected by a chemical agent supply modulation system in accordance with a system operating cycle. It is understood that the distribution can be effected to an additional destination. The system operating cycle includes a single system supply mode and a single system bypass mode. The system bypass mode follows the system supply mode. The system operating cycle is repeated at least once such that alternating is effected as between the system supply mode and the system bypass mode, and such that a corresponding plurality of occurrences of the system supply mode and a corresponding plurality of occurrences of the system bypass mode are provided.

In a related aspect, the controllably supplying includes modulating distribution of the chemical agent, between at least a flowing process fluid and a fluid bypass 24, as it is being discharged by the chemical agent supply system 12, wherein the modulation is effected by a chemical agent supply modulation system having a distribution affecting condition which alternates between a system supply mode and a system bypass mode. It is understood that the distribution can be effected to an additional destination. The alternating is such that a plurality of occurrences of the system supply mode and a corresponding plurality of occurrences of the system bypass mode are provided.

Over the entire duration of the system supply mode, fluid communication between the chemical agent supply system 12 and the flowing process fluid is being effected. Over the entire duration of the system bypass mode, fluid communication between the chemical agent supply system 12 and the fluid bypass 24 is being effected.

In some embodiments, for example, the chemical agent supply modulation system includes a bypass fluid flow interference device 18 and a fluid pressure-responsive sealing device 20.

The bypass fluid flow interference device 18 is disposed in a supply mode condition co-extensively with the occurrence of the system supply mode, and is disposed in a bypass mode condition co-extensively with the occurrence of the system bypass mode.

The bypass fluid flow interference device 18 is disposed between the chemical agent supply system 12 and the fluid bypass 24, and is configured for selectively interfering with fluid communication between the chemical agent supply system 12 and a fluid bypass 24. When disposed in the supply mode condition, the bypass fluid flow interference device 18 is disposed so as to effect relatively more interference with fluid communication between the chemical agent supply system 12 and the fluid bypass 24 (such as, for example, blocking of the fluid communication), than when disposed in the bypass mode condition.

In some embodiments, for example, the bypass fluid flow interference device 18 is a throttling device. In some embodiments, for example, the bypass fluid flow interference device 18 is a valve. In some embodiments, for example, the bypass fluid flow interference device 18 is a Kimray™ High Pressure Motor Valve 1400 SMT, 4000 psi working pressure, Cat # EAG, fail close. In some embodiments, for example, the device 18 is a solenoid-actuated valve. In those embodiments where the bypass fluid flow interference device 18 is a valve, in some of these embodiments, for example, effecting relatively more interference includes effecting a reduction in the percentage opening of the bypass fluid interference device (i.e. valve), and effecting relatively less interference includes effecting an increase in the percentage opening of the bypass fluid flow interference device 18.

The fluid pressure-responsive sealing device 20 is disposed between the chemical agent supply system 12 and the flowing process fluid, and is urged by downstream fluid pressure, for effecting sealing, or substantial sealing, of the fluid communication between the chemical agent supply system 12 and the flowing process fluid. The downstream fluid pressure is being communicated by the flowing process fluid. The fluid pressure-responsive sealing device 20 is configured to effect the sealing, or substantial sealing, while fluid pressure upstream of the fluid pressure-responsive sealing device 20 is failing to sufficiently exceed the downstream fluid pressure.

In some embodiments, for example, the fluid pressure-responsive sealing device 20 is a non-return valve (or a check valve). In some embodiments, for example, the fluid pressure-responsive sealing device 20 includes a sealing member that is configured for effect sealing, or substantial sealing, of the fluid communication between the chemical agent supply system 12 and the flowing process fluid when the upstream fluid pressure, acting upon the upstream facing surface of the sealing member, fails to sufficiently exceed the downstream fluid pressure, acting upon the downstream facing surface of the sealing member. In some embodiments, for example, the fluid pressure-responsive sealing device 20 includes two check valves 20, 20*a* that are disposed, in series, between the chemical agent supply system 12 and the flowing process fluid.

The bypass fluid flow interference device 18 and the fluid pressure-responsive sealing device 20 are co-operatively configured such that, while the chemical agent supply system 12 is pressurizing the chemical agent upstream of both of the bypass fluid flow interference device 18 and the fluid pressure-responsive sealing device 20, the fluid pressure upstream of the fluid pressure-responsive sealing device 20, which opposes the downstream fluid pressure that is urging the fluid pressure-responsive sealing device 20 to effect sealing, or substantial sealing, of the fluid communication between the chemical agent supply system 12 and the flowing process fluid, is responsive to the degree of interference being effected, to the fluid communication between the chemical agent supply system 12 and the fluid bypass 24, by the bypass fluid flow interference device 18.

It is understood that, for at least some embodiments, the controlling of the supply of chemical agent to the flowing process fluid, with the fluid pressure-responsive sealing device 20, based on indirect control of the upstream fluid pressure by the bypass fluid flow interference device 18, eliminates the requirement for a separate control valve, with separate control logic.

In some embodiments, for example, the discharging is continuous. In other embodiments, for example, the discharging is intermittent.

In some embodiments, for example, when disposed in the supply mode condition, and while the chemical agent supply system 12 is pressurizing the chemical agent upstream of both of the bypass fluid flow interference device 18 and the fluid pressure-responsive sealing device 20, the bypass fluid flow interference device 18 is disposed so as to effect a relatively higher fluid pressure upstream of the fluid pressure-responsive sealing device 20, than when disposed in the bypass mode condition. In this respect, in those embodiments where the bypass fluid flow interference device 18 is a valve, when disposed in the bypass mode condition, the bypass fluid flow interference device 18 is disposed at a greater percentage opening than when disposed in the supply mode condition.

In some embodiments, for example, when the bypass fluid flow interference device 18 is disposed in the supply mode condition, and while the chemical agent supply system 12 is pressurizing the chemical agent upstream of both of the bypass fluid flow interference device 18 and the fluid pressure-responsive sealing device 20, the effected upstream fluid pressure is sufficiently exceeding the downstream fluid pressure such that fluid communication between the chemical agent supply system 12 and the flowing process fluid is being effected.

In some embodiments, for example, while the chemical agent supply system 12 is pressurizing the chemical agent upstream of both of the bypass fluid flow interference device 18 and the fluid pressure-responsive sealing device 20, sealing, or substantial sealing of fluid communication between the chemical agent supply system 12 and the flowing process fluid is being effected by the fluid pressure-responsive sealing device 20 when the degree of interference being effected by the bypass fluid flow interference device 18, while disposed in the bypass mode condition, is such that the effected upstream fluid pressure is failing to sufficiently exceed the downstream fluid pressure.

In some embodiments, for example, for at least one of the occurrences of the system supply mode (such as, for example, for every one of the occurrences), during the occurrence of the system supply mode (such as, for example, over the entire duration of the occurrence), chemical agent is being discharged by the chemical agent supply system 12, and while the discharging is being effected, at least a fraction of the chemical agent being discharged by the chemical agent supply system 12 is supplied to the flowing process fluid. In some of these embodiments, for example, the at least a fraction is at least 75% of the total volumetric amount of the chemical agent being discharged by the chemical agent supply system 12. In some of these embodiments, for example, during the occurrence of the system supply mode (such as, for example, over the entire duration of the occurrence), while the discharging is being effected, at least a fraction of the chemical agent, being discharged by the chemical agent supply system 12, is supplied to the fluid bypass 24. In some embodiments, for example, during the occurrence of the system supply mode (such as, for example, over the entire duration of the occurrence), all, or substantially all, of the chemical agent, being discharged by the chemical agent supply system 12, is supplied to the flowing process fluid, such that none, or substantially none, of the chemical agent being discharged by the chemical agent supply system 12, is supplied to the fluid bypass 24.

In some embodiments, for example, for at least one of the occurrences of the system supply mode (such as, for example, every one of the occurrences), during the occurrence of the system supply mode (such as, for example, over the entire duration of the occurrence), the sealing, or substantial sealing, of fluid communication, between chemical agent supply system 12 and the fluid bypass 24, is being effected by the bypass fluid flow interference device 18, and chemical agent is being discharged by the chemical agent supply system 12. In this respect, during the occurrence of the system supply mode, discharging of the chemical agent by the chemical agent supply system 12 is being effected while sealing, or substantial sealing, of fluid communication, between the chemical agent supply system 12 and the fluid bypass 24, is being effected by the bypass fluid flow interference device 18. During the occurrence of the system supply mode, and while the discharging is being effected, all, or substantially all, of the chemical agent, that is being discharged by the chemical agent supply system 12, is being supplied to the flowing process fluid. In those embodiments where the bypass fluid flow interference device 18 is a valve, the sealing, or substantial sealing, of fluid communication, between the chemical agent supply system 12 and the fluid bypass 24, is being effected by the bypass fluid flow interference device 18, when the bypass fluid flow interference device 18 is disposed in a closed, or substantially closed, position.

In some embodiments, for example, for at least one of the occurrences of the system supply mode (such as, for example, every one of the occurrences), over the entire duration of the occurrence of the system supply mode, the sealing, or substantial sealing, of fluid communication, between chemical agent supply system 12 and the fluid bypass 24, is being effected by the bypass fluid flow interference device 18, and, during the occurrence of the system supply mode (such as, for example, over the entire duration of the occurrence, but not necessarily so), chemical agent is being discharged by the chemical agent supply system 12. In this respect, during the occurrence of the system supply mode, discharging of the chemical agent by the chemical agent supply system 12 is being effected while sealing, or substantial sealing, of fluid communication, between chemical agent supply system 12 and the fluid bypass 24, is being effected by the bypass fluid flow interference device 18. During the occurrence of the system supply mode, and while the discharging is being effected, all, or substantially all, of the chemical agent that is being discharged by the chemical agent supply system 12 is being supplied to the flowing process fluid. In those embodiments where the bypass fluid flow interference device 18 is a valve, the sealing, or substantial sealing, of fluid communication, between the chemical agent supply system 12 and the fluid bypass 24, is being effected by the bypass fluid flow interference device 18, when the bypass fluid flow interference device 18 is disposed in a closed, or substantially closed, position.

In some embodiments, for example, for at least one of the occurrences of the system bypass mode (such as, for example, every one of the occurrences), during the occurrence of the system bypass mode (such as, for example, over the entire duration of the occurrence), chemical agent is being discharged by the chemical agent supply system 12, and while the discharging is being effected, at least a fraction of the chemical agent being discharged by the chemical agent supply system 12 is supplied to the fluid bypass 24. In some of these embodiments, for example, the at least a fraction is at least 75% of the total volumetric amount of the chemical agent being discharged by the chemical agent supply system 12. In some of these embodiments, for example, during the occurrence of the system bypass mode, while the discharging is being effected, at least a fraction of the chemical agent, being discharged by the chemical agent supply system 12, is supplied to the flowing process fluid. In some embodiments, for example, during the occurrence of the system bypass mode, all, or substantially all, of the chemical agent, being discharged by the chemical agent supply system 12, is supplied to the bypass fluid, such that none, or substantially none, of the chemical agent being discharged by the chemical agent supply system 12, is supplied to the flowing process fluid.

In some embodiments, for example, for at least one of the occurrences of the system bypass mode (such as, for example, every one of the occurrences), during the occurrence of the system bypass mode (such as, for example, over the entire duration of the occurrence), the bypass fluid flow interference device 18 is disposed such that fluid communication between the chemical agent supply system 12 and the fluid bypass 24 is being effected, and the chemical agent supply system 12 is pressurizing the chemical agent upstream of both of the bypass fluid flow interference device 18 and the fluid pressure-responsive sealing device 20 and the disposition of the bypass fluid flow interference device 18 is such that the effected upstream fluid pressure is failing to sufficiently exceed the downstream fluid pressure such that sealing, or substantial sealing, of fluid communication between the chemical agent supply system 12 and the flowing process fluid is being effected by the fluid pressure-responsive sealing device 20, and chemical agent is being discharged by the chemical agent supply system 12. The sealing, or substantial sealing, of fluid communication, between the chemical agent supply system 12 and the flowing process fluid, is being effected by the fluid pressure-responsive sealing device 20 by closing the fluid passage between the chemical agent supply system 12 and the flowing process fluid. In this respect, during the occurrence of the system bypass mode, discharging of the chemical agent by the chemical agent supply system 12 is being effected while the bypass fluid flow interference device 18 is disposed such that fluid communication between the chemical agent supply system 12 and the fluid bypass 24 is being effected. Also, in this respect, such discharging is being effected while the chemical agent supply system 12 is pressurizing the chemical agent upstream of both of the bypass fluid flow interference device 18 and the fluid pressure-responsive sealing device 20, and the disposition of the bypass fluid flow interference device 18 is such that the effected upstream fluid pressure is failing to sufficiently exceed the downstream fluid pressure such that sealing, or substantial sealing, of fluid communication between the chemical agent supply system 12 and the flowing process fluid is being effected by the fluid pressure-responsive sealing device 20. During the occurrence of the system bypass mode, and while the discharging is being effected, all, or substantially all, of the chemical agent, that is being discharged by the chemical agent supply system 12, is being supplied to the fluid bypass. The sealing, or substantial sealing, of fluid communication, between the chemical agent supply system 12 and the flowing process fluid, is being effected by the fluid pressure-responsive sealing device 20 by closing the fluid passage between the chemical agent supply system 12 and the flowing process fluid.

In some embodiments, for example, for at least one of the occurrences of the system bypass mode (such as, for example, every one of the occurrences), (i) over the entire duration of the occurrence of the system bypass mode, the bypass fluid flow interference device 18 is disposed such that fluid communication between the chemical agent supply system 12 and the fluid bypass 24 is being effected and such that, while the chemical agent supply system 12 is pressurizing the chemical agent upstream of both of the bypass fluid flow interference device 18 and the fluid pressure-responsive sealing device 20, the effected upstream fluid pressure is failing to sufficiently exceed the downstream fluid pressure such that sealing, or substantial sealing, of fluid communication between the chemical agent supply system 12 and the flowing process fluid is being effected by the fluid pressure-responsive sealing device 20, and, (ii) during the occurrence of the system bypass mode (such as, for example, over the entire duration of the occurrence, but not necessarily so), the chemical agent supply system 12 is pressurizing the chemical agent upstream of both of the bypass fluid flow interference device 18 and the fluid pressure-responsive sealing device 20 and the disposition of the bypass fluid flow interference device 18 is such that the effected upstream fluid pressure is failing to sufficiently exceed the downstream fluid pressure such that sealing, or substantial sealing, of fluid communication between the chemical agent supply system 12 and the flowing process fluid is being effected by the fluid pressure-responsive sealing device 20, and chemical agent is being discharged by the chemical agent supply system 12. The sealing, or substantial sealing, of fluid communication, between the chemical agent supply system 12 and the flowing process fluid, is being effected by the fluid pressure-responsive sealing device 20 by closing the fluid passage between the chemical agent supply system 12 and the flowing process fluid. In this respect, during the occurrence of the system bypass mode, discharging of the chemical agent by the chemical agent supply system 12 is being effected while the bypass fluid flow interference device 18 is disposed such that fluid communication between the chemical agent supply system 12 and the fluid bypass 24 is being effected, and while the chemical agent supply system 12 is pressurizing the chemical agent upstream of both of the bypass fluid flow interference device 18 and the fluid pressure-responsive sealing device 20 and the disposition of the bypass fluid flow interference device 18 is such that the effected upstream fluid pressure is failing to sufficiently exceed the downstream fluid pressure such that sealing, or substantial sealing, of fluid communication between the chemical agent supply system 12 and the flowing process fluid is being effected by the fluid pressure-responsive sealing device 20. During the occurrence of the system bypass mode, and while the discharging is being effected, all, or substantially all, of the chemical agent, that is being discharged by the chemical agent supply system 12, is being supplied to the fluid bypass.

In some embodiments, for example, the discharging is intermittent, and the intermittent discharging is such that a plurality of successively spaced-apart (in time) slugs of chemical agent are discharged by the chemical agent supply system 12. For at least one of the occurrences of the system supply mode (such as, for example, every one of the occurrences), during the occurrence of the system supply mode, one or more of the plurality of successively spaced-apart (in time) slugs of chemical agent are discharged by the chemical agent supply system 12, wherein, for at least one (such as, for example, every one) of the one or more of the plurality of successively spaced-apart slugs of chemical agent that are discharged by the chemical agent supply system 12, while the slug is being discharged, at least a fraction of the slug being discharged by the chemical agent supply system 12 is being supplied to the flowing process fluid. In some embodiments, for example, the at least a fraction is at least 75% of the total volumetric amount of the chemical agent being discharged by the chemical agent supply system 12. In some embodiments, for example, during the occurrence of the system supply mode, while the discharging is being effected, at least a fraction of the chemical agent, being discharged by the chemical agent supply system 12, is supplied to the fluid bypass 24. In some embodiments, for example, during the occurrence of the system supply mode, all, or substantially all, of the chemical agent, being discharged by the chemical agent supply system 12, is supplied to the flowing process fluid, such that none, or substantially none, of the chemical agent being discharged by the chemical agent supply system 12, is supplied to the fluid bypass 24.

In some embodiments, for example, the discharging is intermittent, and the intermittent discharging is such that a plurality of successively spaced-apart (in time) slugs of chemical agent are discharged by the chemical agent supply system 12, and for at least one of the occurrences of the system supply mode (such as, for example, every one of the occurrences), during the occurrence of the system supply mode (such as, for example, over the entire duration of the occurrence), the sealing, or substantial sealing, of fluid communication, between chemical agent supply system 12 and the fluid bypass 24, is being effected by the bypass fluid flow interference device 18, and one or more of the plurality of successively spaced-apart slugs of chemical agent are discharged by the chemical agent supply system 12. In this respect, during the occurrence of the system supply mode, discharging of one or more of the plurality of successively spaced-apart slugs of the chemical agent by the chemical agent supply system 12 are being effected while sealing, or substantial sealing, of fluid communication, between the chemical agent supply system 12 and the fluid bypass 24, is being effected by the bypass fluid flow interference device 18. During the occurrence of the system supply mode, and, for each one of the one or more of the plurality of successively spaced-apart slugs of the chemical agent, that are being discharged by the chemical agent supply system 12, while the discharging is being effected, the entirety, or substantially the entirety, of the slug, that is discharged by the chemical agent supply system 12, is being supplied to the flowing process fluid. In those embodiments where the bypass fluid flow interference device 18 is a valve, the sealing, or substantial sealing, of fluid communication, between the chemical agent supply system 12 and the fluid bypass 24, is being effected by the bypass fluid flow interference device 18, when the bypass fluid flow interference device 18 is disposed in a closed, or substantially closed, position.

In some embodiments, for example, the discharging is intermittent, and the intermittent discharging is such that a plurality of successively spaced-apart (in time) slugs of chemical agent are discharged by the chemical agent supply system 12, and for at least one of the occurrences of the system supply mode (such as, for example, every one of the occurrences), (i) over the entire duration of the occurrence of the system supply mode, the sealing, or substantial sealing, of fluid communication, between chemical agent supply system 12 and the fluid bypass 24, is being effected by the bypass fluid flow interference device 18, and, (ii) during the occurrence of the system supply mode, one or more of the plurality of successively spaced-apart slugs of chemical agent are discharged by the chemical agent supply system 12. In this respect, during the occurrence of the system supply mode, discharging of one or more of the plurality of successively spaced-apart slugs of the chemical agent by the chemical agent supply system 12 are being effected while sealing, or substantial sealing, of fluid communication, between the chemical agent supply system 12 and the fluid bypass 24, is being effected by the bypass fluid flow interference device 18. During the occurrence of the system supply mode, and, for each one of the one or more of the plurality of successively spaced-apart slugs of the chemical agent, that are being discharged by the chemical agent supply system 12, while the discharging is being effected, the entirety, or substantially the entirety, of the slug, that is discharged by the chemical agent supply system 12, is being supplied to the flowing process fluid. In those embodiments where the bypass fluid flow interference device 18 is a valve, the sealing, or substantial sealing, of fluid communication, between the chemical agent supply system 12 and the fluid bypass 24, is being effected by the bypass fluid flow interference device 18, when the bypass fluid flow interference device 18 is disposed in a closed, or substantially closed, position.

In some embodiments, for example, the discharging is intermittent, and the intermittent discharging is such that a plurality of successively spaced-apart (in time) slugs of chemical agent are discharged by the chemical agent supply system 12, and for at least one of the occurrences of the system bypass mode (such as, for example, every one of the occurrences), during the occurrence of the system bypass mode, one or more of the plurality of successively spaced-apart (in time) slugs of chemical agent are discharged by the chemical agent supply system 12. For at least one (such as, for example, every one) of the one or more of the plurality of successively spaced-apart slugs of chemical agent that are discharged by the chemical agent supply system 12, while the slug is being discharged, at least a fraction of the slug being discharged by the chemical agent supply system 12 is being supplied to the fluid bypass 24. In some of these embodiments, for example, the at least a fraction is at least 75% of the total volumetric amount of the chemical agent being discharged by the chemical agent supply system 12. In some embodiments, for example, during the occurrence of the system bypass mode, while the discharging is being effected, at least a fraction of the chemical agent, being discharged by the chemical agent supply system 12, is supplied to the flowing process fluid. In some embodiments, for example, during the occurrence of the system bypass mode, all, or substantially all, of the chemical agent, being discharged by the chemical agent supply system 12, is supplied to the bypass fluid, such that none, or substantially none, of the chemical agent being discharged by the chemical agent supply system 12, is supplied to the flowing process fluid.

In some embodiments, for example, the discharging is intermittent, and the intermittent discharging is such that a plurality of successively spaced-apart (in time) slugs of chemical agent are discharged by the chemical agent supply system 12, and for at least one of the occurrences of the system bypass mode (such as, for example, every one of the occurrences), during the occurrence of the system bypass mode (such as, for example, over the entire duration of the occurrence), the bypass fluid flow interference device 18 is disposed such that fluid communication between the chemical agent supply system 12 and the fluid bypass 24 is being effected, and the chemical agent supply system 12 is pressurizing the chemical agent upstream of both of the bypass fluid flow interference device 18 and the fluid pressure-responsive sealing device 20 and the disposition of the bypass fluid flow interference device 18 is such that the effected upstream fluid pressure is failing to sufficiently exceed the downstream fluid pressure such that sealing, or substantial sealing, of fluid communication between the chemical agent supply system 12 and the flowing process fluid is being effected by the fluid pressure-responsive sealing device 20, and one or more of the plurality of successively spaced-apart slugs of chemical agent are discharged by the chemical agent supply system 12. In this respect, during the occurrence of the system bypass mode, discharging of one or more of the plurality of successively spaced-apart slugs of the chemical agent by the chemical agent supply system 12 are being effected while the bypass fluid flow interference device 18 is disposed such that fluid communication between the chemical agent supply system 12 and the fluid bypass 24 is being effected, and while the chemical agent supply system 12 is pressurizing the chemical agent upstream of both of the bypass fluid flow interference device 18 and the fluid pressure-responsive sealing device 20 and the disposition of the bypass fluid flow interference device 18 is such that the effected upstream fluid pressure is failing to sufficiently exceed the downstream fluid pressure such that sealing, or substantial sealing, of fluid communication between the chemical agent supply system 12 and the flowing process fluid is being effected by the fluid pressure-responsive sealing device 20. During the occurrence of the system bypass mode, and, for each one of the one or more of the plurality of successively spaced-apart slugs of the chemical agent, that are being discharged by the chemical agent supply system 12, while the discharging is being effected, the entirety, or substantially the entirety, of the slug, that is discharged by the chemical agent supply system 12, is being supplied to the fluid bypass 24. The sealing, or substantial sealing, of fluid communication, between the chemical agent supply system 12 and the flowing process fluid, is being effected by the fluid pressure-responsive sealing device 20 by closing the fluid passage between the chemical agent supply system 12 and the flowing process fluid.

In some embodiments, for example, the discharging is intermittent, and the intermittent discharging is such that a plurality of successively spaced-apart (in time) slugs of chemical agent are discharged by the chemical agent supply system 12, and for at least one of the occurrences of the system bypass mode (such as, for example, every one of the occurrences), (i) over the entire duration of the occurrence of the system bypass mode, the bypass fluid flow interference device 18 is disposed such that fluid communication between the chemical agent supply system 12 and the fluid bypass 24 is being effected and such that, while the chemical agent supply system 12 is pressurizing the chemical agent upstream of both of the bypass fluid flow interference device 18 and the fluid pressure-responsive sealing device 20, the effected upstream fluid pressure is failing to sufficiently exceed the downstream fluid pressure such that sealing, or substantial sealing, of fluid communication between the chemical agent supply system 12 and the flowing process fluid is being effected by the fluid pressure-responsive sealing device 20, and, (ii) during the occurrence of the system bypass mode, the chemical agent supply system 12 is pressurizing the chemical agent upstream of both of the bypass fluid flow interference device 18 and the fluid pressure-responsive sealing device 20 and the disposition of the bypass fluid flow interference device 18 is such that the effected upstream fluid pressure is failing to sufficiently exceed the downstream fluid pressure such that sealing, or substantial sealing, of fluid communication between the chemical agent supply system 12 and the flowing process fluid is being effected by the fluid pressure-responsive sealing device 20, and one or more of the plurality of successively spaced-apart slugs of chemical agent are discharged by the chemical agent supply system 12. In this respect, during the occurrence of the system bypass mode, discharging of one or more of the plurality of successively spaced-apart slugs of the chemical agent by the chemical agent supply system 12 are being effected while the bypass fluid flow interference device 18 is disposed such that fluid communication between the chemical agent supply system 12 and the fluid bypass 24 is being effected, and while the chemical agent supply system 12 is pressurizing the chemical agent upstream of both of the bypass fluid flow interference device 18 and the fluid pressure-responsive sealing device 20 and the disposition of the bypass fluid flow interference device 18 is such that the effected upstream fluid pressure is failing to sufficiently exceed the downstream fluid pressure such that sealing, or substantial sealing, of fluid communication between the chemical agent supply system 12 and the flowing process fluid is being effected by the fluid pressure-responsive sealing device 20. During the occurrence of the system bypass mode, and, for each one of the one or more of the plurality of successively spaced-apart slugs of the chemical agent, that are being discharged by the chemical agent supply system 12, while the discharging is being effected, the entirety, or substantially the entirety, of the slug, that is discharged by the chemical agent supply system 12, is being supplied to the fluid bypass 24. The sealing, or substantial sealing, of fluid communication, between the chemical agent supply system 12 and the flowing process fluid, is being effected by the fluid pressure-responsive sealing device 20 by closing the fluid passage between the chemical agent supply system 12 and the flowing process fluid.

In some embodiments, for example, the fluid pressure-responsive sealing device 20 is disposed within a chemical agent supply fluid passage, between the chemical agent supply system 12 and the flowing process fluid. When the fluid pressure-responsive sealing device 20 is disposed such that sealing, or substantial sealing, of fluid communication between the chemical agent supply system 12 and the flowing process fluid is effected, the process further includes pressurizing the chemical agent which is disposed within the chemical agent supply fluid passage, upstream of the fluid pressure-responsive sealing device 20, such that the pressure of the chemical agent supply fluid passage-disposed chemical agent, upstream of the fluid pressure-responsive sealing device 20, sufficiently exceeds the downstream fluid pressure, and effects a change in disposition of the fluid pressure-responsive sealing device 20 such that fluid communication between the chemical agent supply system 12 and the flowing process fluid is effected. The pressurizing is effected by the chemical agent supply system 12. The portion of the chemical agent supply fluid passage, within which is disposed the chemical agent that becomes pressurized by the chemical agent supply system 12 such that the chemical agent supply fluid passage-disposed chemical agent becomes disposed at the sufficiently exceeding pressure for effecting disposition of the fluid pressure-responsive interference device such that fluid communication between the chemical agent supply system 12 and the flowing process fluid is effected, defines an operative chemical agent receiving space, and the operative chemical agent receiving space has a total volume that is less than 100 milliliters. In some embodiments, for example, the total volume is less than 75 milliliters. In some embodiments, for example, the total volume is less than 70 milliliters.

In some embodiments, for example, during at least one of the occurrences of the system bypass mode (such as, for example, every one of the occurrences), and while the discharging of the chemical agent is being effected, at least a fraction of the chemical agent that is being discharged by the chemical agent supply system 12 and supplied to the fluid bypass 24 is recirculated. In some of these embodiments, for example, during at least one of the occurrences of the system bypass mode (such as, for example, every one of the occurrences), and while the discharging of the chemical agent is being effected, the entirety, or substantially the entirety, of the chemical agent that is being discharged by the chemical agent supply system 12 and supplied to the fluid bypass 24 is recirculated.

In some embodiments, for example, the occurrences of the system supply mode are successively spaced apart (in time) relative to one another such that there is provided a corresponding plurality of pairs of successively spaced apart ones of the plurality of occurrences of the supply mode. In some of these embodiments, for example, for each one of the occurrences of the system bypass mode, the beginning of the system bypass mode merges with the completion of an earlier one of a corresponding pair of successively spaced apart ones of the plurality of occurrences of the system supply mode, and the completion of the system bypass mode merges with the beginning of the later one of the corresponding pair of successively spaced apart ones of the plurality of occurrences of the system supply mode. It is understood that the above-described merging of the system supply modes and the system bypass modes does not necessarily occur for all embodiments, and that, in some embodiments, one or more system bypass modes may be spaced apart from one of, or both, of the corresponding pair of successively spaced apart ones of the plurality of occurrences of the system supply mode.

In some embodiments, for example, both of the system supply mode and the system bypass mode are characterized by a predetermined time duration.

With respect to the aspect of modulating in accordance with a system operating cycle, in those embodiments where the chemical agent supply system 12 includes a single-stage reciprocating pump 16, in some of these embodiments, for example, the system operating cycle is characterized by a total time duration that is less than 240 seconds. In some of these embodiments, for example, the system operating cycle is characterized by a total time duration that is less than 180 seconds. In some of these embodiments, for example, the system operating cycle is characterized by a total time duration that is less than 150 seconds. In some of these embodiments, for example, the reduced supply time period is defined as being less than the above-stated maximums, for the purpose of approximating continuous supply of a desired rate of chemical agent, while mitigating over-injection.

Also with respect to the aspect of modulating in accordance with a system operating cycle, in those embodiments where the chemical agent supply system 12 includes a single-stage reciprocating pump 16, in some of these embodiments, for example, the system operating cycle is characterized by a total time duration that is greater than 60 seconds. In some of these embodiments, for example, the system operating cycle is characterized by a total time duration that is greater than 90 seconds. In some of these embodiments, for example, the system operating cycle is characterized by a total time duration that is greater than 120 seconds. In some of these embodiments, for example, the cycle period is defined as being more than the above-stated minimums, for the purpose of increasing the probability that the supply mode is occurring while the single-stage reciprocating pump 16 is disposed in a discharge stroke condition. In this respect, for a single-stage reciprocating pump 16 characterized by a pump 16 stroke that is 30 seconds (or less) (i.e. a relatively, very slow-stroking pump 16), it has been observed that a system operating cycle, having a total time duration of 60 seconds, results in, over time, a deviation from the target rate of injection that is, in some operational implementations, undesirable.

Figure 6:
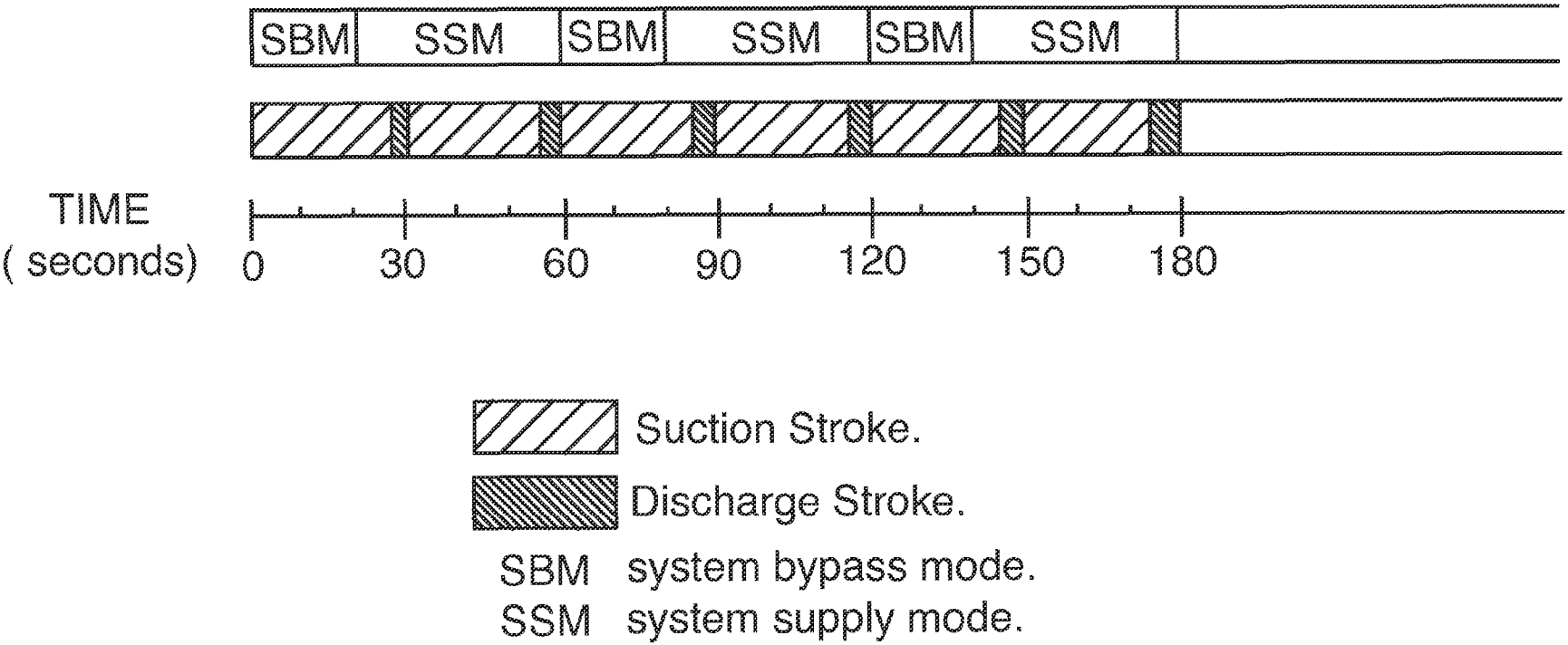
FIG. 6 is a timing diagram for supply mode and bypass mode conditions for the bypass fluid flow interference device, and for suction and discharge strokes for a pump having a 30 second stroke.

FIG. 6 is a timing diagram for supply mode and bypass mode conditions for the bypass fluid flow interference device 18, and for suction and discharge strokes for a single stage reciprocating pump 16 having a 30 second stroke, the 30 second stroke consisting of a 26 second suction stroke and a four (4) second discharge stroke. It is understood that, during at least some instances of operation, discharging of chemical agent is being effected during at least a portion of the duration (and, in some of these instances, over the entire duration) of the discharge stroke, but that, in some instances, no chemical agent is being discharged over the entire duration of the discharge stroke. In those instances where no chemical agent is being discharged during (such as over the entire duration of) the discharge stroke, it is understood that, in these instances, the pump 16 is pressurizing the chemical agent upstream of the fluid pressure-responsive sealing device 20 so as to overcome the downstream pressure which is urging the fluid pressure-responsive sealing device 20 to effect sealing, or substantial sealing, of fluid communication between the chemical agent supply system 12 and the flowing process fluid. Further, it is evident that, even in those instances when the chemical agent is being discharged over the entire duration of the discharge stroke, and the bypass fluid interference device 18 is disposed in the supply mode condition over the entire duration of the discharging, the discharging is occurring only over a fraction of the time interval over which the bypass fluid flow interference device 18 is disposed in the supply mode condition. Similarly, and although not shown, in those instances when the chemical agent is being discharged over the entire duration of the discharge stroke, and the bypass fluid interference device 18 is disposed in the bypass mode condition over the entire duration of the discharging, the discharging would be occurring only over a fraction of the time interval over which the bypass fluid flow interference device 18 is disposed in the bypass mode condition.

In some embodiments, for example, the system operating cycle is characterized by a predetermined time duration, and is defined by alternating the condition of the device 18 between the supply mode condition and the bypass mode condition. In those embodiments where, in the supply mode condition, the entirety, or substantially the entirety, of the chemical agent that is being discharged by the chemical agent supply system 12, is supplied to the flowing process fluid, and in the bypass mode condition, none, or substantially none, of the chemical agent that is being discharged by the chemical agent supply system 12, is supplied to the flowing process fluid, and where the chemical agent supply system 12 includes a single-stage reciprocating pump, the duration of the supply mode condition is based upon the characteristic pump rate of the single-stage reciprocating pump, the target rate of supply of the chemical agent, the build time, and the duration of the cycle period of the system operating cycle. In some of these embodiments, for example, additionally, the duration of the supply mode condition is based upon the pressure of the flowing process fluid, and this affects the build time. The calculation of the duration of the supply mode condition, is as follows:

Injection Period(duration of supply mode condition)=
[[Target Rate/Actual(or pump)Rate]×[Cycle Period]]+Build Time Once the duration of the supply mode condition is determined, the duration of the bypass mode condition is effectively defined as being the remainder of the cycle period.

In some embodiments, for example, the change in condition of the bypass fluid flow interference device 18, from one of the supply mode condition and the bypass mode condition to the other one of the supply mode condition and the bypass mode condition, is effected by a controller, based on the duration of the cycle period, and the respective duration of each one of the supply mode condition and the bypass mode condition. In this respect, in some embodiments, for example, the duration of the cycle period is pre-programmed into the controller, and the controller is configured for receiving operator input of the variables: characteristic pump rate, target rate, and build time, and the inputs of these variables will determine the injection period. In some of these embodiments, for example, the controller is further configured for receiving operator input of the pressure of the flowing process fluid, which is translated to a build time component, which is added to the injection period.

Figure 2:
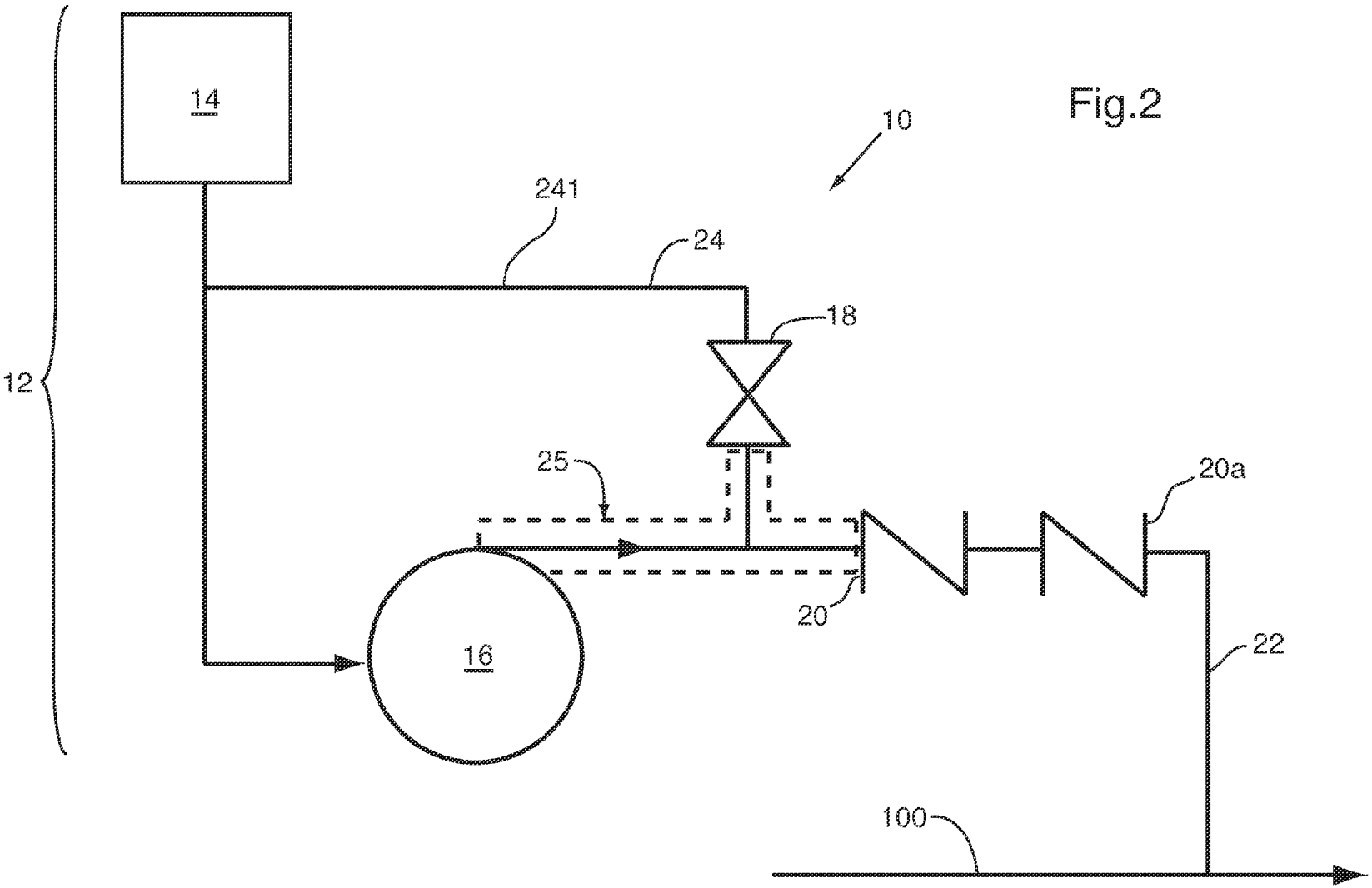
FIG. 2 is a process flow diagram of another embodiment of the present disclosure.
Figure 3:
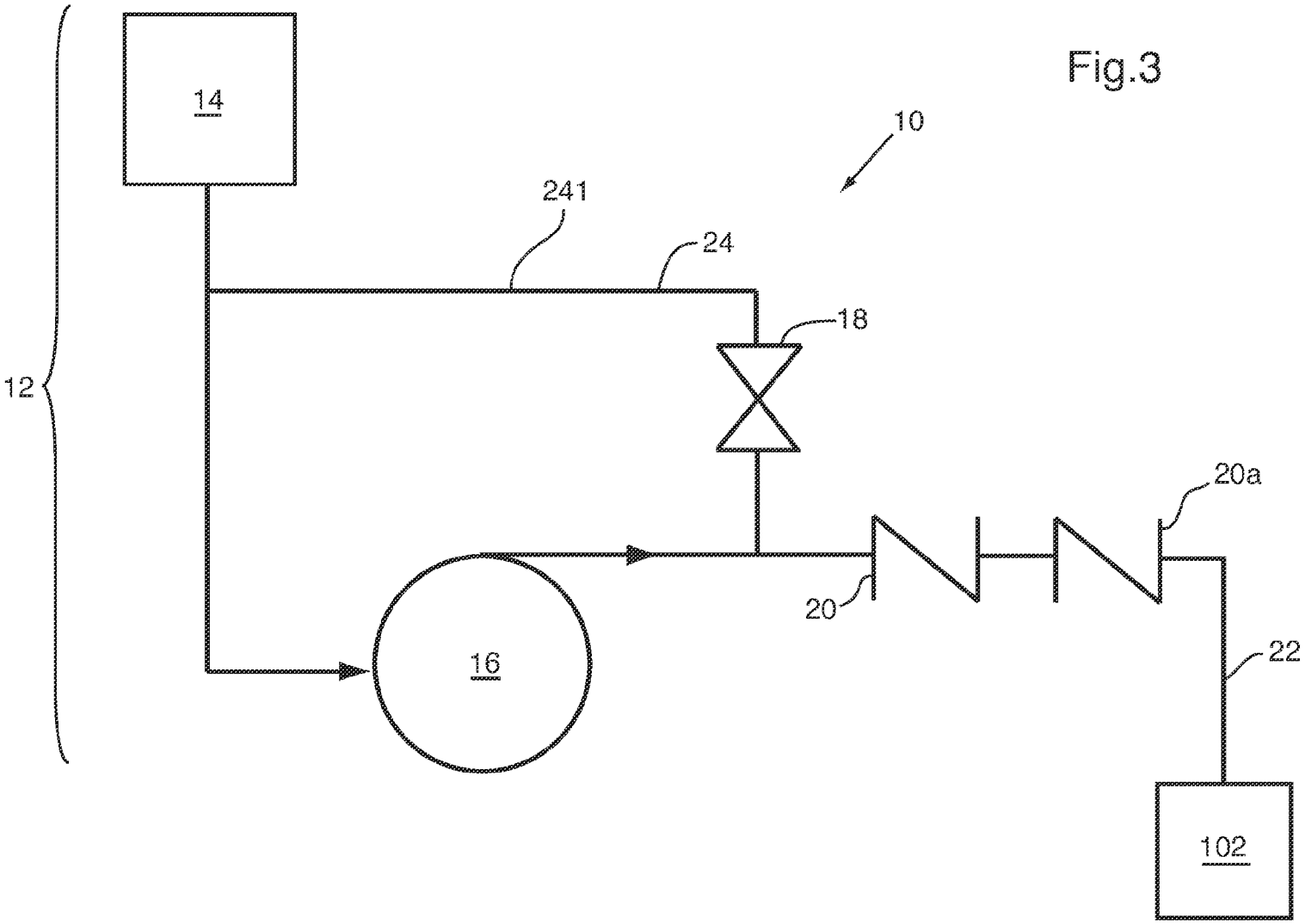
FIG. 3 is a process flow diagram of an experimental set-up for testing chemical injection rates for variable system operating cycles.

FIG. 3 is a process flow diagram illustrating the experimental set-up, for testing rate of chemical injection from a single stage reciprocating pump, having a 30 second pump stroke, for different cycle durations of a system operating cycle, which determined supply mode and bypass mode conditions of the bypass fluid flow interference device 18, disposed in recirculation piping 182, wherein, in the supply mode condition, all, or substantially all, of the of the chemical agent that is being discharged by the chemical agent supply system 12, is supplied to the flowing process fluid, and, in the bypass mode condition, all, or substantially all, of the of the chemical agent that is being discharged by the chemical agent supply system 12, is supplied to the fluid bypass. The experimental set-up was identical to the configuration in FIG. 2, with the exception that, rather than being fluidly connected to the process fluid conduit, the chemical agent supply fluid passageway fluidly connected to a pressure vessel 102. The pressure vessel 102 contained pressurized gaseous diatomic nitrogen, for simulating fluid pressure of the flowing process fluid. The pressure vessel 102 was fluidly connected to a pressurized bottle containing gaseous diatomic nitrogen, for supplying of the gaseous diatomic nitrogen to the pressure vessel, and the pressure vessel 102 was outfitted with a pressure regulator for enabling simulation of different fluid pressures within the pipeline (i.e. fluid conduit). The prime mover 16 used was a Texsteam 5100™, manufactured by Texsteam Inc. Initially, a pump rate was obtained by starting the pump and using the calibrated sight glass on the pump. In this specific embodiment, the calibrated sight glass used was one manufactured by Plains Fabrication & Supply of Calgary, Alberta, and the sight glass was marked in one (1) liter/day increments. The pump was operated for one (1) minute, and the number of increments of fluid that were removed from the sight glass was used to define the pump rate.

The pump rate, target rate, chosen cycle period, and fluid pressure within the pressure vessel 102 were input into the controller, and, based on this information, the controller determined the duration of the injection period (i.e. the duration of the system supply mode, and, therefore the duration of the system bypass mode), in accordance with the calculation described above. The inputted pressure is correlated with an experimentally determined build time, The build time is additional time from the operating cycle which is allocated to the system supply mode, and, in part, compensates for the fact that pressurization of the chemical agent by the pump 16, for a portion of the system supply mode, is used for effecting an increase in pressure of the chemical agent to a sufficient pressure in order to overcome the flowing fluid pressure and effect opening of the fluid pressure-responsive sealing device and thereby effect supplying of the chemical agent to the pressure vessel 102, and that no chemical agent is discharged and supplied to the pressure vessel 102 during this portion of the system supply mode. In the present example, for an inputted pressure of between 0 to 6880 kPa, the added build time was 6 seconds, for an inputted pressure of between 6881 and 13790 kPa, the added build time was 10 seconds, and for an inputted pressure of between 13791 to 27580 kPa, the added build time was 14 seconds.

The bypass valve 18 was electrically coupled to the controller for receiving signals from the controller. The controller and bypass valve 18 were co-operatively coupled such that, over the entire duration of the system supply mode, disposition of the bypass valve 18 in a fully closed position (i.e. sealing, or substantial sealing, of fluid communication between the pump 16 and the fluid bypass), and also to effect, over the entire duration of the system bypass mode, disposition of the bypass valve 18 in the fully opened position (i.e. effecting fluid communication between the pump 16 and the fluid bypass), and actuation of the bypass valve 18 as between the fully open and fully closed conditions was configured to be effected in response to a signal sent by the controller to the bypass valve 18. Testing was then commenced by starting the pump and powering on the controller (and thereby controlling the opening/closing of the bypass valve 18, based on the receiving, by the bypass valve 18, of signals from the controller). FIG. 4 illustrates the test results for a one-minute cycle period. Clearly, operating the system, for a one-minute cycle period, over a 24 hour period, yielded under-injection. FIG. 5 illustrates the test results for a two-minute cycle period. Experiments were conducted with different upstream fluid pressures (upstream of the check valve 20), thereby affecting the specified build time component. Comparatively, operating the system, for a two-minute cycle period, over a 24 hour period, yielded injection at rates much closer to the target rate, versus a one-minute cycle period.

In another aspect, there is provided a system for controllably supplying a chemical agent to a flowing process fluid for effecting generation of treated flowing fluid including a chemical agent-derived fluid component material, wherein the chemical agent-derived fluid component material is derived from the chemical agent. The system includes the chemical agent supply system 12, the bypass fluid flow interference device 18, and the a fluid pressure-responsive sealing device 20.

The chemical agent supply system 12 is configured for discharging a chemical agent, and disposed for fluid communication with each one of, independently, the process fluid conduit 100 and the fluid bypass conduit 241. In this respect, the chemical agent supply system 12 is configured for discharging a chemical agent and supplying a chemical agent, at any one time, to one of, or both of, the process fluid conduit 100 and the fluid bypass conduit 241.

The bypass fluid flow interference device 18 is disposed between the chemical agent supply system 12 and the fluid bypass conduit 241, and configured for selectively interfering with fluid communication between the chemical agent supply system and the fluid bypass conduit. The bypass fluid flow interference device is disposable to a supply mode condition, wherein fluid communication between the chemical agent supply system and the process fluid conduit is being effected, and is also disposable to a bypass mode condition, wherein fluid communication between the chemical agent supply system and the fluid bypass conduit is being effected. When the bypass fluid flow interference device is disposed in the supply mode condition, the bypass fluid flow interference device is disposed so as to effect relatively more interference to fluid communication between the chemical agent supply system and the fluid bypass conduit, than when disposed in the bypass mode condition.

The fluid pressure-responsive sealing device 20 is disposed between the chemical agent supply system 12 and the process fluid conduit 100. The device 20 is configured for being urged by downstream fluid pressure being communicated from the process fluid conduit, for effecting sealing, or substantial sealing, of the fluid communication between the chemical agent supply system and the process fluid conduit, such that the sealing, or substantial sealing, is effected while fluid pressure upstream of the fluid pressure-responsive sealing device is failing to sufficiently exceed the downstream fluid pressure.

The bypass fluid flow interference device 18 and the fluid pressure-responsive sealing device 20 are co-operatively configured such that, while the chemical agent supply system 12 is pressurizing the chemical agent upstream of both of the bypass fluid flow interference device and the fluid pressure-responsive sealing device, fluid pressure upstream of the fluid pressure-responsive sealing device, which opposes the downstream fluid pressure that is urging the fluid pressure-responsive sealing device to effect the sealing, or substantial sealing, of the fluid communication between the chemical agent supply system and the process fluid conduit, is responsive to the degree of interference being effected, to the fluid communication between the chemical agent supply system and the fluid bypass conduit, by the bypass fluid flow interference device. As such, when the bypass fluid flow interference device is disposed in the supply mode condition, and while the chemical agent supply system is pressurizing the chemical agent upstream of both of the bypass fluid flow interference device and the fluid pressure-responsive sealing device, the bypass fluid flow interference device is disposed so as to effect a fluid pressure upstream of the fluid pressure-responsive sealing device that sufficiently exceeds the downstream fluid pressure such that fluid communication between the chemical agent supply system and the process fluid conduit is being effected.

In some embodiments, for example, the disposition of the bypass fluid flow interference device 18 in the bypass mode condition is such that, while the chemical agent supply system 12 is pressurizing the chemical agent upstream of both of the bypass fluid flow interference device 18 and the fluid pressure responsive sealing device 20, the degree of interference being effected by the bypass fluid flow interference device 18 is such that the effected upstream fluid pressure is failing to sufficiently exceed the downstream fluid pressure, such that sealing, or substantial sealing, of fluid communication between the chemical agent supply system 12 and the process fluid conduit 100 is being effected by the fluid pressure responsive sealing device 20.

In some embodiments, for example, the system also includes a controller. The change in disposition of the bypass fluid flow interference device 18, from one of the supply mode condition and the bypass mode condition to the other one of the supply mode condition and the bypass mode condition, is effected by a controller, in response to a signal sent by the controller. In some of these embodiments, the effecting of the change in condition of the bypass fluid flow interference device 18, from one of the supply mode condition and the bypass mode condition to the other one of the supply mode condition and the bypass mode condition, by the controller, is based upon a predetermined operating cycle that is repeated at least once, wherein the predetermined operating cycle includes a single system supply mode, defined by a respective predetermined time duration, and a single system bypass mode, defined by a respective time duration. The system bypass mode follows the system supply mode. The system operating cycle is repeated at least once such that alternating is effected as between the system supply mode and the system bypass mode. The occurrence of system supply mode is coextensive with the occurrence of the disposition of the bypass fluid flow interference device 18 in the supply mode condition. The occurrence of system bypass mode is coextensive with the occurrence of the disposition of the bypass fluid flow interference device 18 in the bypass mode condition.

2. Volume of Chemical Agent Upstream of Fluid Pressure-Responsive Sealing Device In another aspect, the process for supplying a chemical agent to a flowing process fluid with a chemical agent supply system 12 includes pressurizing, with the chemical agent supply system 12, chemical agent which is disposed within a chemical agent supply fluid passage. The fluid pressure-responsive sealing device 20 is disposed within the chemical agent supply fluid passage, between the chemical agent supply system 12 and the flowing process fluid, the fluid pressure-responsive sealing device 20 being urged by downstream fluid pressure, communicated by the flowing process fluid, for effecting sealing, or substantial sealing, of the fluid communication between the chemical agent supply system 12 and the flowing process fluid. The fluid pressure-responsive sealing device 20 is configured for effecting the sealing, or substantial sealing, while fluid pressure upstream of the fluid pressure-responsive sealing device 20 is failing to sufficiently exceed the downstream fluid pressure, and wherein the chemical agent being pressurized is disposed upstream of the fluid pressure-responsive sealing device 20. The pressurizing is effected when the fluid pressure-responsive sealing device 20 is disposed such that sealing, or substantial sealing, of fluid communication between the chemical agent supply system 12 and the flowing process fluid is being effected. The pressurizing is such that the pressure of the chemical agent supply fluid passage-disposed chemical agent, upstream of the fluid pressure-responsive sealing device 20, sufficiently exceeds the downstream fluid pressure so as to effect a change in disposition of the fluid pressure-responsive sealing device 20 such that fluid communication between the chemical agent supply system 12 and the flowing process fluid is effected, and supplying of the flowing process fluid, with at least a fraction of the chemical agent being discharged by the chemical agent supply system 12, is effected. The portion of the chemical agent supply fluid passage, within which is disposed the chemical agent that becomes pressurized by the chemical agent supply system 12 such that the chemical agent supply fluid passage-disposed chemical agent becomes disposed at the sufficiently exceeding pressure for effecting disposition of the fluid pressure-responsive interference device such that fluid communication between the chemical agent supply system 12 and the flowing process fluid is effected, has a total volume that is less than 100 milliliters. In some embodiments, for example, the total volume is less than 75 milliliters. In some embodiments, for example, the total volume is less than 70 milliliters.

The total volume of this portion of the chemical agent supply fluid passage is defined to be relatively small, so that, after an increase in the degree of interference effected by the bypass fluid flow interference device 18 to the fluid communication between the chemical agent supply system 12 and the fluid bypass 24 (such as, for example, by effecting sealing of the fluid communication between the chemical agent supply system 12 and the fluid bypass 24 with the bypass fluid flow interference device 18) is effected, discharging of the chemical agent (post-increased interference discharging), effected by the chemical agent supply system 12, effects a sufficient increase in fluid pressure upstream of the fluid pressure-responsive sealing device 20 so as to effect changing of the condition of the fluid pressure-responsive sealing device 20 from a fluid communication sealing condition (sealing, or substantial sealing, of fluid communication between the chemical agent supply system 12 and the flowing process fluid is being effected) to a fluid communication facilitating condition (fluid communication between the chemical agent supply system 12 and the flowing process fluid), and thereby initiate the supplying of the chemical agent to the flowing process fluid, within an acceptable time duration after the post-increased interference discharging is initiated.

Referring to FIG. 2, in some embodiments, for example, the chemical agent being discharged by the chemical agent supply system 12 is discharged into the chemical agent supply fluid passage 22. The chemical agent supply fluid passage extends from the chemical agent supply system 12 and is fluidly connected to both of the process fluid conduit and to the fluid bypass, such that a fluidly interconnected chemical agent supply fluid passage network 25 is thereby provided between the chemical agent supply system 12 and both of the process fluid conduit and the fluid bypass. The fluid pressure-responsive sealing device 20 is disposed within the chemical agent supply fluid passage 22, between the chemical agent supply system 12 and the process fluid conduit. The bypass fluid flow interference device 18 is disposed within the chemical agent supply fluid passage 22, between the chemical agent supply system 12 and the fluid bypass. In those embodiments where the bypass fluid flow interference device 18 is configured to effect, in at least one condition, sealing, or substantial sealing, of the fluid communication between the chemical agent supply system 12 and the fluid bypass, such that the interfering includes effecting the sealing, or substantial sealing, of the fluid communication, in those operational conditions where the sealing, or substantial sealing, of fluid communication between the chemical agent supply system 12 and the fluid bypass is being effected, and the chemical agent supply system 12 is disposed in a condition such that discharging of the chemical agent is suspended (i.e. no, or substantially no, chemical agent is being discharged by the chemical agent supply system and supplied into the fluid passage), the fluid pressure-responsive sealing device 20 is disposed such that sealing, or substantial sealing, of fluid communication between the chemical agent supply system 12 and the flowing process fluid is being effected. In such embodiments, for example, the portion of the chemical agent supply fluid passage 22, which defines the operative chemical agent receiving space, is that portion extending from the chemical agent supply system 12 and to each one of the fluid pressure-responsive sealing device 20 and the bypass fluid flow interference device 18, while the fluid pressure-responsive sealing device 20 is disposed in a condition such that sealing, or substantial sealing, of the fluid communication between the chemical agent supply system 12 and the flowing process fluid is being effected, and while the bypass fluid flow interference device 18 is disposed in a condition such that sealing, or substantial sealing, of the fluid communication between the chemical agent supply system 12 and the fluid bypass is being effected.

In another aspect, there is provided a system for supplying a chemical agent to a flowing process fluid with the chemical agent supply system 12, wherein the supplying effects generation of treated flowing fluid comprising a chemical agent-derived fluid component material, wherein the chemical agent-derived fluid component material is derived from the chemical agent. The system includes the chemical agent supply system 12, the chemical agent supply fluid passage 22, and the fluid pressure-responsive sealing device 20.

The chemical agent supply system 12 is configured for discharging a chemical agent, and disposed for fluid communication with each one of, independently, a process fluid conduit and a fluid bypass conduit. In this respect, the chemical agent supply system 12 is configured for discharging a chemical agent and supplying a chemical agent, at any one time, to one of, or both of, the process fluid conduit 100 and the fluid bypass conduit 241.

The fluid pressure-responsive sealing device 20 is disposed within the chemical agent supply fluid passage 22, between the chemical agent supply system 12 and the process fluid conduit 100. The device 20 is configured for being urged by downstream fluid pressure being communicated from the process fluid conduit 100, for effecting sealing, or substantial sealing, of the fluid communication between the chemical agent supply system 12 and the process fluid conduit 100, such that the sealing, or substantial sealing, is effected while fluid pressure upstream of the fluid pressure-responsive sealing device is failing to sufficiently exceed the downstream fluid pressure;

While chemical agent, disposed within the chemical agent supply fluid passage 22, upstream of the fluid pressure-responsive sealing device 20, is being pressurized by the chemical agent supply system 12, wherein the pressurizing is effected when the fluid pressure-responsive sealing device 20 is disposed such that sealing, or substantial sealing, of fluid communication between the chemical agent supply system 12 and the process fluid conduit is being effected, such that the pressure of the chemical agent supply fluid passage-disposed chemical agent, upstream of the fluid pressure-responsive sealing device 20, sufficiently exceeds the downstream fluid pressure, and effects a change in disposition of the fluid pressure-responsive sealing device 20 such that fluid communication between the chemical agent supply system 12 and the process fluid conduit 100 is effected, the portion of the chemical agent supply fluid passage 22, within which is disposed the chemical agent that becomes pressurized by the chemical agent supply system 12 such that the chemical agent supply fluid passage-disposed chemical agent becomes disposed at the sufficiently exceeding pressure for effecting disposition of the fluid pressure-responsive interference device 20 such that fluid communication between the chemical agent supply system 12 and the process fluid conduit 100 is effected, has a total volume that is less than 100 milliliters.

While this invention has been described with reference to illustrative embodiments and examples, the description is not intended to be construed in a limiting sense. Thus, various modifications of the illustrative embodiments, as well as other embodiments of the invention, will be apparent to persons skilled in the art upon reference to this description. It is therefore contemplated that the appended claims will cover any such modifications or embodiments. Further, all of the claims are hereby incorporated by reference into the description of the preferred embodiments.

The invention claimed is:

1. A process for controllably supplying a chemical agent to a flowing process fluid for effecting generation of treated flowing fluid comprising a chemical agent-derived fluid component material, wherein the chemical agent-derived fluid component material is derived from the chemical agent, wherein the controllably supplying comprises:

while discharging a chemical agent from a chemical agent supply system, modulating distribution of the chemical agent that is being discharged, between at least a flowing process fluid and a fluid bypass, with a chemical agent supply modulation system, in accordance with a system operating cycle, wherein the system operating cycle includes a single system supply mode and a single system bypass mode, and wherein the system bypass mode follows the system supply mode, and wherein the system operating cycle is repeated at least once such that alternating is effected as between the system supply mode and the system bypass mode, and such that a corresponding plurality of occurrences of the system supply mode and a corresponding plurality of occurrences of the system bypass mode are provided;

wherein, over the entire duration of the system supply mode, fluid communication between the chemical agent supply system and the flowing process fluid is being effected;

wherein, over the entire duration of the system bypass mode, fluid communication between the chemical agent supply system and the fluid bypass is being effected;

and wherein the chemical agent supply modulation system includes a supply fluid passage network providing continuous fluidic communication from the chemical agent supply system to both a bypass fluid flow interference device on a bypass branch and a fluid pressure-responsive sealing device on a chemical agent supply branch, wherein the bypass fluid flow interference device is spaced away from a junction between the bypass branch and the chemical agent supply branch, and wherein the bypass fluid flow interference device is configured to be positively actuated;

wherein, over the entire duration of the system supply mode, the bypass fluid flow interference device is disposed in a supply mode condition, and over the entire duration of the system bypass mode, the bypass fluid flow interference device is disposed in a bypass mode condition;

and wherein the bypass fluid flow interference device is disposed between the chemical agent supply system and the fluid bypass, and is configured for positively and selectively interfering with fluid communication between the chemical agent supply system and the fluid bypass, and when disposed in the supply mode condition, the bypass fluid flow interference device is disposed so as to positively affect relatively more interference with fluid communication between the chemical agent supply system and the fluid bypass, than when disposed in the bypass mode condition;

and wherein the fluid pressure-responsive sealing device is disposed between the chemical agent supply system and the flowing process fluid, and is urged by downstream fluid pressure, for effecting sealing, or substantial sealing, of the fluid communication between the chemical agent supply system and the flowing process fluid, and the fluid pressure-responsive sealing device is configured to effect the sealing, or substantial sealing, while fluid pressure upstream of the fluid pressure-responsive sealing device is failing to sufficiently exceed the downstream fluid pressure, wherein the downstream fluid pressure is being communicated by the flowing process fluid;

and wherein the bypass fluid flow interference device and the fluid pressure-responsive sealing device are co-operatively configured such that, while the chemical agent supply system is pressurizing the chemical agent upstream of both of the bypass fluid flow interference device and the fluid pressure-responsive sealing device, the fluid pressure upstream of the fluid pressure responsive sealing device, which opposes the downstream fluid pressure that is urging the fluid pressure-responsive sealing device to effect sealing, or substantial sealing, of the fluid communication between the chemical agent supply system and the flowing process fluid, is responsive to the degree of interference being effected, to the fluid communication between the chemical agent supply system and the fluid bypass, by the bypass fluid flow interference device.

2. The process as claimed in claim 1;

wherein, when disposed in the supply mode condition, and while the chemical agent supply system is pressurizing the chemical agent upstream of both of the bypass fluid flow interference device and the fluid pressure-responsive sealing device, the bypass fluid flow interference device is disposed so as to effect a relatively higher fluid pressure upstream of the fluid pressure-responsive sealing device, than when disposed in the bypass mode condition.

3. The process as claimed in claim 2;

wherein, when the bypass fluid flow interference device is disposed in the supply mode condition, and while the chemical agent supply system is pressurizing the chemical agent upstream of both of the bypass fluid flow interference device and the fluid pressure-responsive sealing device, the effected upstream fluid pressure is sufficiently exceeding the downstream fluid pressure such that fluid communication between the chemical agent supply system and the flowing process fluid is being effected.

4. The process as claimed in claim 3;

wherein, while the chemical agent supply system is pressurizing the chemical agent upstream of both of the bypass fluid flow interference device and the fluid pressure-responsive sealing device, sealing, or substantial sealing of fluid communication between the chemical agent supply system and the flowing process fluid is being effected by the fluid pressure-responsive sealing device when the degree of interference being effected by the bypass fluid flow interference device, while disposed in the bypass mode condition, is such that the effected upstream fluid pressure is failing to sufficiently exceed the downstream fluid pressure.

5. The process as claimed in claim 4;

wherein, for at least one of the occurrences of the system supply mode, during the occurrence of the system supply mode, chemical agent is being discharged by the chemical agent supply system, and wherein, while the discharging is being effected, at least a fraction of the chemical agent being discharged by the chemical agent supply system is supplied to the flowing process fluid.

6. The process as claimed in claim 5;

wherein the at least a fraction is at least 75% of the total volumetric amount of the chemical agent being discharged by the chemical agent supply system.

7. The process as claimed in claim 4;

wherein, for at least one of the occurrences of the system supply mode:

during the occurrence of the system supply mode, the sealing, or substantial sealing, of fluid communication, between chemical agent supply system and the fluid bypass, is being effected by the bypass fluid flow interference device, and chemical agent is being discharged by the chemical agent supply system;

such that, during the occurrence of the system supply mode, discharging of the chemical agent by the chemical agent supply system is being effected while sealing, or substantial sealing, of fluid communication, between the chemical agent supply system and the fluid bypass, is being effected by the bypass fluid flow interference device:

wherein, during the occurrence of the system supply mode, and while the discharging is being effected, all, or substantially all, of the chemical agent, that is being discharged by the chemical agent supply system, is being supplied to the flowing process fluid.

8. The process as claimed in claim 7;

wherein, for at least one of the occurrences of the system bypass mode, during the occurrence of the system bypass mode, chemical agent is being discharged by the chemical agent supply system, and wherein, while the discharging is being effected, at least a fraction of the chemical agent being discharged by the chemical agent supply system is supplied to the fluid bypass.

9. The process as claimed in claim 8;

wherein the at least a fraction is at least 75% of the total volumetric amount of the chemical agent being discharged by the chemical agent supply system.

10. The process as claimed in claim 8;

wherein, for at least one of the occurrences of the system bypass mode:

during the occurrence of the system bypass mode, the bypass fluid flow interference device is disposed such that fluid communication between the chemical agent supply system and the fluid bypass is being effected, and the chemical agent supply system is pressurizing the chemical agent upstream of both of the bypass fluid flow interference device and the fluid pressure-responsive sealing device and the disposition of the bypass fluid flow interference device is such that the effected upstream fluid pressure is failing to sufficiently exceed the downstream fluid pressure such that sealing, or substantial sealing, of fluid communication between the chemical agent supply system and the flowing process fluid is being effected by the fluid pressure-responsive sealing device, and chemical agent is being discharged by the chemical agent supply system;

such that, during the occurrence of the system bypass mode, discharging of the chemical agent by the chemical agent supply system is being effected while the bypass fluid flow interference device is disposed such that fluid communication between the chemical agent supply system and the fluid bypass is being effected, and while the chemical agent supply system is pressurizing the chemical agent upstream of both of the bypass fluid flow interference device and the fluid pressure-responsive sealing device and the disposition of the bypass fluid flow interference device is such that the effected upstream fluid pressure is failing to sufficiently exceed the downstream fluid pressure such that sealing, or substantial sealing, of fluid communication between the chemical agent supply system and the flowing process fluid is being effected by the fluid pressure-responsive sealing device;

wherein, during the occurrence of the system bypass mode, and while the discharging is being effected, all, or substantially all, of the chemical agent, that is being discharged by the chemical agent supply system, is being supplied to the fluid bypass.

11. The process as claimed in claim 1:

wherein the discharging is continuous.

12. The process as claimed in claim 1;

wherein the discharging is intermittent.

13. The process as claimed in claim 12;

wherein the discharging is intermittent, and the intermittent discharging is such that a plurality of successively spaced-apart, in time, slugs of chemical agent are discharged by the chemical agent supply system;

and wherein, for at least one of the occurrences of the system supply mode, during the occurrence of the system supply mode, one or more of the plurality of successively spaced-apart slugs of chemical agent are discharged by the chemical agent supply system;

and wherein for at least one of the one or more of the plurality of successively spaced-apart slugs of chemical agent that are discharged by the chemical agent supply system, while the slug is being discharged, at least a fraction of the slug being discharged by the chemical agent supply system is being supplied to the flowing process fluid.

14. The process as claimed in claim 13;

wherein the at least a fraction is at least 75% of the total volumetric amount of the chemical agent being discharged by the chemical agent supply system.

15. The process as claimed in claim 13;

wherein, for at least one of the occurrences of the system supply mode:

during the occurrence of the system supply mode, the sealing, or substantial sealing, of fluid communication, between chemical agent supply system and the fluid bypass, is being effected by the bypass fluid flow interference device, and one or more of the plurality of successively spaced-apart slugs of chemical agent arc discharged by the chemical agent supply system;

such that, during the occurrence of the system supply mode, discharging of one or more of the plurality of successively spaced-apart slugs of the chemical agent by the chemical agent supply system are being effected while sealing, or substantial sealing, of fluid communication, between the chemical agent supply system and the fluid bypass, is being effected by the bypass fluid flow interference device;

wherein, during the occurrence of the system supply mode, and, for each one of the one or more of the plurality of successively spaced-apart slugs of the chemical agent, that are being discharged by the chemical agent supply system, while the discharging is being effected, the entirety, or substantially the entirety, of the slug, that is discharged by the chemical agent supply system, is being supplied to the flowing process fluid.

16. The process as claimed in claim 13;

wherein, for at least one of the occurrences of the system bypass mode, during the occurrence of the system bypass mode, one or more of the plurality of successively spaced-apart slugs of chemical agent are discharged by the chemical agent supply system;

and wherein for at least one of the one or more of the plurality of successively spaced-apart slugs of chemical agent that are discharged by the chemical agent supply system, while the slug is being discharged, at least a fraction of the slug being discharged by the chemical agent supply system is being supplied to the fluid bypass.

17. The process as claimed in claim 16, wherein the at least a fraction is at least 75% of the total volumetric amount of the chemical agent being discharged by the chemical agent supply system.

18. The process as claimed in claim 16;

wherein, for at least one of the occurrences of the system bypass mode:

during the occurrence of the system bypass mode, the bypass fluid flow interference device is disposed such that fluid communication between the chemical agent supply system and the fluid bypass is being effected, and the chemical agent supply system is pressurizing the chemical agent upstream of both of the bypass fluid flow interference device and the fluid pressure-responsive sealing device and the disposition of the bypass fluid flow interference device is such that the effected upstream fluid pressure is failing to sufficiently exceed the downstream fluid pressure such that sealing, or substantial sealing, of fluid communication between the chemical agent supply system and the flowing process fluid is being effected by the fluid pressure-responsive sealing device, and one or more of the plurality of successively spaced-apart slugs of chemical agent are discharged by the chemical agent supply system, such that, during the occurrence of the system bypass mode, discharging of one or more of the plurality of successively spaced-apart slugs of the chemical agent by the chemical agent supply system are being effected while the bypass fluid flow interference device is disposed such that fluid communication between the chemical agent supply system and the fluid bypass is being effected, and while the chemical agent supply system is pressurizing the chemical agent upstream of both of the bypass fluid flow interference device and the fluid pressure-responsive sealing device and the disposition of the bypass fluid flow interference device is such that the effected upstream fluid pressure is failing to sufficiently exceed the downstream fluid pressure such that sealing, or substantial sealing, of fluid communication between the chemical agent supply system and the flowing process fluid is being effected by the fluid pressure-responsive sealing device;

wherein, during the occurrence of the system bypass mode, and, for each one of the one or more of the plurality of successively spaced-apart slugs of the chemical agent, that are being discharged by the chemical agent supply system, while the discharging is being effected, the entirety, or substantially the entirety, of the slug, that is discharged by the chemical agent supply system, is being supplied to the fluid bypass.

19. The process as claimed in claim 1, further comprising:

pressurizing the chemical agent, disposed within a chemical agent supply fluid passage, upstream of the fluid pressure-responsive sealing device, wherein the fluid pressure-responsive sealing device is disposed within the chemical agent supply fluid passage, between the chemical agent supply system and the flowing process fluid, wherein the pressurizing is effected by the chemical agent supply system;

wherein, the pressurizing is effected when the fluid pressure-responsive sealing device is disposed such that sealing, or substantial sealing, of fluid communication between the chemical agent supply system and the flowing process fluid is effected, such that the pressure of the chemical agent supply fluid passage-disposed chemical agent, upstream of the fluid pressure-responsive sealing device, sufficiently exceeds the downstream fluid pressure, and effects a change in disposition of the fluid pressure-responsive sealing device such that fluid communication between the chemical agent supply system and the flowing process fluid is effected;

wherein the portion of the chemical agent supply fluid passage, within which is disposed the chemical agent that becomes pressurized by the chemical agent supply system such that the chemical agent supply fluid passage-disposed chemical agent becomes disposed at the sufficiently exceeding pressure for effecting disposition of the fluid pressure-responsive interference device such that fluid communication between the chemical agent supply system and the flowing process fluid is effected, has a total volume that is less than 100 milliliters.

20. The process as claimed in claim 1:

wherein the chemical agent supply system includes a prime mover for effecting the pressurization of the chemical agent.

21. The process as claimed in claim 20;

wherein the prime mover includes a single-stage reciprocating pump.

22. The process as claimed in claim 1:

wherein, during at least one of the occurrences of the system bypass mode, and while the discharging of the chemical agent is being effected, at least a fraction of the chemical agent that is being discharged by the chemical agent supply system and supplied to the fluid bypass is recirculated.

23. A process for controllably supplying a chemical agent to a flowing process fluid for effecting generation of treated flowing fluid comprising a chemical agent-derived fluid component material, wherein the chemical agent-derived fluid component material is derived from the chemical agent, wherein the controllably supplying comprises:

while discharging a chemical agent from a chemical agent supply system, modulating distribution of the chemical agent that is being discharged, between at least a flowing process fluid and a fluid bypass, with a chemical agent supply modulation system, wherein the distribution affecting condition of the chemical agent supply modulation system alternates between a system supply mode and a system bypass mode such that a plurality of occurrences of the system supply mode and a corresponding plurality of occurrences of the system bypass mode are provided;

wherein, over the entire duration of the system supply mode, fluid communication between the chemical agent supply system and the flowing process fluid is being effected;

and wherein, over the entire duration of the system bypass mode, fluid communication between the chemical agent supply system and the fluid bypass is being effected;

and wherein the chemical agent supply modulation system includes a supply fluid passage network providing continuous fluid communication from the chemical agent supply system to both a bypass fluid flow interference device located on a bypass branch and a fluid pressure-responsive sealing device located on a chemical agent supply branch, the bypass fluid flow interference device being spaced away from a junction between the bypass branch and the chemical agent supply branch, wherein the fluid flow interference device is also configured to be positively actuated;

and wherein, over the entire duration of the system supply mode, the bypass fluid flow interference device is disposed in a supply mode condition, and over the entire duration of the system bypass mode, the bypass fluid flow interference device being actuated so as to be disposed in a bypass mode condition;

and wherein the bypass fluid flow interference device is disposed between the chemical agent supply system and the fluid bypass, and is configured for selectively interfering with fluid communication between the chemical agent supply system and the fluid bypass, and when disposed in the supply mode condition, the bypass fluid flow interference device is positively actuated so as to effect relatively more interference with fluid communication between the chemical agent supply system and the fluid bypass, than when disposed in the bypass mode condition;

and wherein the fluid pressure-responsive sealing device is disposed between the chemical agent supply system and the flowing process fluid, and is urged by downstream fluid pressure, for effecting sealing, or substantial sealing, of the fluid communication between the chemical agent supply system and the flowing process fluid, and the fluid pressure-responsive sealing device is configured to effect the sealing, or substantial sealing, while fluid pressure upstream of the fluid pressure-responsive sealing device is failing to sufficiently exceed the downstream fluid pressure, wherein the downstream fluid pressure is being communicated by the flowing process fluid;

and wherein the bypass fluid flow interference device and the fluid pressure-responsive sealing device are co-operatively configured such that, while the chemical agent supply system is pressurizing the chemical agent upstream of both of the bypass fluid flow interference device and the fluid pressure-responsive sealing device, the fluid pressure upstream of the fluid pressure-responsive sealing device, which opposes the downstream fluid pressure that is urging the fluid pressure-responsive sealing device to effect sealing, or substantial sealing, of the fluid communication between the chemical agent supply system and the flowing process fluid, is responsive to the degree of interference being effected, to the fluid communication between the chemical agent supply system and the fluid bypass, by the bypass fluid flow interference device.

24. The process as claimed in claim 23:

wherein, when disposed in the supply mode condition, and while the chemical agent supply system is pressurizing the chemical agent upstream of both of the bypass fluid flow interference device and the fluid pressure-responsive sealing device, the bypass fluid flow interference device is disposed so as to effect a relatively higher fluid pressure upstream of the fluid pressure-responsive sealing device, than when disposed in the bypass mode condition.

25. The process as claimed in claim 24;

wherein, when the bypass fluid flow interference device is disposed in the supply mode condition, and while the chemical agent supply system is pressurizing the chemical agent upstream of both of the bypass fluid flow interference device and the fluid pressure-responsive sealing device, the effected upstream fluid pressure is sufficiently exceeding the downstream fluid pressure such that fluid communication between the chemical agent supply system and the flowing process fluid is being effected.

26. The process as claimed in claim 25;

wherein, while the chemical agent supply system is pressurizing the chemical agent upstream of both of the bypass fluid flow interference device and the fluid pressure-responsive sealing device, sealing, or substantial sealing of fluid communication between the chemical agent supply system and the flowing process fluid is being effected by the fluid pressure-responsive sealing device when the degree of interference being effected by the bypass fluid flow interference device, while disposed in the bypass mode condition, is such that the effected upstream fluid pressure is failing to sufficiently exceed the downstream fluid pressure.

27. The process as claimed in claim 26;

wherein, for at least one of the occurrences of the system supply mode, during the occurrence of the system supply mode, chemical agent is being discharged by the chemical agent supply system, and wherein, while the discharging is being effected, at least a fraction of the chemical agent being discharged by the chemical agent supply system is supplied to the flowing process fluid.

28. The process as claimed in claim 27:

wherein the at least a fraction is at least 75% of the total volumetric amount of the chemical agent being discharged by the chemical agent supply system.

29. The process as claimed in claim 27;

wherein, for at least one of the occurrences of the system supply mode:

during the occurrence of the system supply mode, the sealing, or substantial sealing, of fluid communication, between chemical agent supply system and the fluid bypass, is being effected by the bypass fluid flow interference device, and chemical agent is being discharged by the chemical agent supply system;

such that, during the occurrence of the system supply mode, discharging of the chemical agent by the chemical agent supply system is being effected while sealing, or substantial sealing, of fluid communication, between the chemical agent supply system and the fluid bypass, is being effected by the bypass fluid flow interference device;

wherein, during the occurrence of the system supply mode, and while the discharging is being effected, all, or substantially all, of the chemical agent, that is being discharged by the chemical agent supply system, is being supplied to the flowing process fluid.

30. The process as claimed in claim 27;

wherein, for at least one of the occurrences of the system bypass mode, and during the occurrence of the system bypass mode, chemical agent is being discharged by the chemical agent supply system, and wherein, while the discharging is being effected, at least a fraction of the chemical agent being discharged by the chemical agent supply system is supplied to the fluid bypass.

31. The process as claimed in claim 30;

wherein the at least a fraction is at least 75% of the total volumetric amount of the chemical agent being discharged by the chemical agent supply system.

32. The process as claimed in claim 30;

wherein, for at least one of the occurrences of the system bypass mode:

during the occurrence of the system bypass mode, the bypass fluid flow interference device is disposed such that fluid communication between the chemical agent supply system and the fluid bypass is being effected, and the chemical agent supply system is pressurizing the chemical agent upstream of both of the bypass fluid flow interference device and the fluid pressure-responsive sealing device and the disposition of the bypass fluid flow interference device is such that the effected upstream fluid pressure is failing to sufficiently exceed the downstream fluid pressure such that sealing, or substantial sealing, of fluid communication between the chemical agent supply system and the flowing process fluid is being effected by the fluid pressure-responsive sealing device, and chemical agent is being discharged by the chemical agent supply system;

such that, during the occurrence of the system bypass mode, discharging of the chemical agent by the chemical agent supply system is being effected while the bypass fluid flow interference device is disposed such that fluid communication between the chemical agent supply system and the fluid bypass is being effected, and while the chemical agent supply system is pressurizing the chemical agent upstream of both of the bypass fluid flow interference device and the fluid pressure-responsive sealing device, and the disposition of the bypass fluid flow interference device is such that the effected upstream fluid pressure is failing to sufficiently exceed the downstream fluid pressure such that sealing, or substantial sealing, of fluid communication between the chemical agent supply system and the flowing process fluid is being effected by the fluid pressure-responsive sealing device;

wherein, during the occurrence of the system bypass mode, and while the discharging is being effected, all, or substantially all, of the chemical agent, that is being discharged by the chemical agent supply system, is being supplied to the fluid bypass.

33. The process as claimed in claim 23;

wherein the discharging is continuous.

34. The process as claimed in claim 23;

wherein the discharging is intermittent.

35. The process as claimed in claim 34;

wherein the discharging is intermittent, and the intermittent discharging is such that a plurality of successively spaced-apart, in time, slugs of chemical agent are discharged by the chemical agent supply system;

and wherein, for at least one of the occurrences of the system supply mode, during the occurrence of the system supply mode, one or more of the plurality of successively spaced-apart, in time, slugs of chemical agent arc discharged by the chemical agent supply system;

and wherein for at least one of the one or more of the plurality of successively spaced-apart slugs of chemical agent that are discharged by the chemical agent supply system, while the slug is being discharged, at least a fraction of the slug being discharged by the chemical agent supply system is being supplied to the flowing process fluid.

36. The process as claimed in claim 35:

wherein the at least a fraction is at least 75% of the total volumetric amount of the chemical agent being discharged by the chemical agent supply system.

37. The process as claimed in claim 35:

wherein, for at least one of the occurrences of the system supply mode:

during the occurrence of the system supply mode, the sealing, or substantial sealing, of fluid communication, between chemical agent supply system and the fluid bypass, is being effected by the bypass fluid flow interference device, and one or more of the plurality of successively spaced-apart slugs of chemical agent arc discharged by the chemical agent supply system;

such that, during the occurrence of the system supply mode, discharging of one or more of the plurality of successively spaced-apart slugs of the chemical agent by the chemical agent supply system are being effected while sealing, or substantial sealing, of fluid communication, between the chemical agent supply system and the fluid bypass, is being effected by the bypass fluid flow interference device;

wherein, during the occurrence of the system supply mode, and, for each one of the one or more of the plurality of successively spaced-apart slugs of the chemical agent, that are being discharged by the chemical agent supply system, while the discharging is being effected, the entirety, or substantially the entirety, of the slug, that is discharged by the chemical agent supply system, is being supplied to the flowing process fluid.

38. The process as claimed in claim 35;

wherein, for at least one of the occurrences of the system bypass mode, during the occurrence of the system bypass mode, one or more of the plurality of successively spaced-apart slugs of chemical agent are discharged by the chemical agent supply system;

and wherein for at least one of the one or more of the plurality of successively spaced-apart slugs of chemical agent that are discharged by the chemical agent supply system, while the slug is being discharged, at least a fraction of the slug being discharged by the chemical agent supply system is being supplied to the fluid bypass.

39. The process as claimed in claim 38;

wherein the at least a fraction is at least 75% of the total volumetric amount of the chemical agent being discharged by the chemical agent supply system.

40. The process as claimed in claim 38:

wherein, for at least one of the occurrences of the system bypass mode:

during the occurrence of the system bypass mode, the bypass fluid flow interference device is disposed such that fluid communication between the chemical agent supply system and the fluid bypass is being effected, and the chemical agent supply system is pressurizing the chemical agent upstream of both of the bypass fluid flow interference device and the fluid pressure-responsive sealing device and the disposition of the bypass fluid flow interference device is such that the effected upstream fluid pressure is failing to sufficiently exceed the downstream fluid pressure such that sealing, or substantial sealing, of fluid communication between the chemical agent supply system and the flowing process fluid is being effected by the fluid pressure-responsive sealing device, and one or more of the plurality of successively spaced-apart slugs of chemical agent are discharged by the chemical agent supply system, such that, during the occurrence of the system bypass mode, discharging of one or more of the plurality of successively spaced-apart slugs of the chemical agent by the chemical agent supply system are being effected while the bypass fluid flow interference device is disposed such that fluid communication between the chemical agent supply system and the fluid bypass is being effected, and while the chemical agent supply system is pressurizing the chemical agent upstream of both of the bypass fluid flow interference device and the fluid pressure-responsive sealing device and the disposition of the bypass fluid flow interference device is such that the effected upstream fluid pressure is failing to sufficiently exceed the downstream fluid pressure such that sealing, or substantial sealing, of fluid communication between the chemical agent supply system and the flowing process fluid is being effected by the fluid pressure-responsive sealing device;

wherein, during the occurrence of the system bypass mode, and, for each one of the one or more of the plurality of successively spaced-apart slugs of the chemical agent, that are being discharged by the chemical agent supply system, while the discharging is being effected, the entirety, or substantially the entirety, of the slug, that is discharged by the chemical agent supply system, is being supplied to the fluid bypass.

41. The process as claimed in claim 23;

pressurizing the chemical agent, disposed within a chemical agent supply fluid passage, upstream of the fluid pressure-responsive sealing device, wherein the fluid pressure-responsive sealing device is disposed within the chemical agent supply fluid passage, between the chemical agent supply system and the flowing process fluid, wherein the pressurizing is effected by the chemical agent supply system;

wherein, the pressurizing is effected when the fluid pressure-responsive sealing device is disposed such that sealing, or substantial sealing, of fluid communication between the chemical agent supply system and the flowing process fluid is effected, such that the pressure of the chemical agent supply fluid passage-disposed chemical agent, upstream of the fluid pressure-responsive sealing device, sufficiently exceeds the downstream fluid pressure, and effects a change in disposition of the fluid pressure-responsive sealing device such that fluid communication between the chemical agent supply system and the flowing process fluid is effected;

wherein the portion of the chemical agent supply fluid passage, within which is disposed the chemical agent that becomes pressurized by the chemical agent supply system such that the chemical agent supply fluid passage-disposed chemical agent becomes disposed at the sufficiently exceeding pressure for effecting disposition of the fluid pressure-responsive interference device such that fluid communication between the chemical agent supply system and the flowing process fluid is effected, has a total volume that is less than 100 milliliters.

42. The process as claimed in claim 23:

wherein the pressure of the flowing process fluid is at least 5 psig.

43. The process as claimed in claim 23;

wherein, during at least one of the occurrences of the system bypass mode, and while the discharging of the chemical agent is affected, at least a traction of the chemical agent that is being discharged by the chemical agent supply system and supplied to the fluid bypass is recirculated.

* * * * *